United States Patent [19]

Engel

[11] Patent Number: 4,850,647

[45] Date of Patent: Jul. 25, 1989

[54] CHAIR

[76] Inventor: Hartmut S. Engel, Schloss Heutingsheim, 7141 Freiberg (Baden-Württemberg, Fed. Rep. of Germany

[21] Appl. No.: 105,128

[22] Filed: Oct. 5, 1987

[30] Foreign Application Priority Data

Oct. 3, 1986 [DE] Fed. Rep. of Germany ..... 3633696

[51] Int. Cl.[4] ..... A47C 1/12

[52] U.S. Cl. ..... 297/446; 297/445; 297/DIG. 2

[58] Field of Search ..... 297/446, 445, DIG. 2

[56] References Cited

U.S. PATENT DOCUMENTS

| | | | |
|---|---|---|---|
| 54,863 | 5/1866 | Cochran | 297/446 |
| 3,208,795 | 9/1965 | Schultz | 297/445 |
| 3,504,942 | 4/1970 | Wong | 297/445 |
| 4,105,250 | 8/1978 | Caldwell | 297/446 X |
| 4,674,799 | 6/1987 | Schwartz et al. | 297/DIG. 2 |
| 4,676,552 | 6/1987 | Hiller | 297/445 |

FOREIGN PATENT DOCUMENTS

| | | |
|---|---|---|
| 1195444 | 6/1965 | Fed. Rep. of Germany . |
| 1171798 | 1/1959 | France . |

*Primary Examiner*—James T. McCall
*Attorney, Agent, or Firm*—Theodore J. Koss, Jr.

[57] ABSTRACT

A chair is disclosed comprising in combination four legs, seat, backrest and a hidden central underframe that supports the seat. Each leg of the chair comprises two leg rods defining a central recess for receiving an arm projecting outwardly from the hidden central underframe.

42 Claims, 14 Drawing Sheets

45.2
37
35
26.3
40
45.1
28
33
22.4
21.3
22.3
41
27
29
30
34
33
46
32
34
46
28
26
95
27
31
22.1
25
33
22.2
26.1
42
36
45.3
37
21.1
45.4
45.5

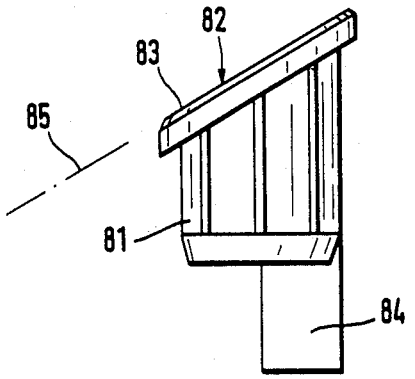
FIG. 10
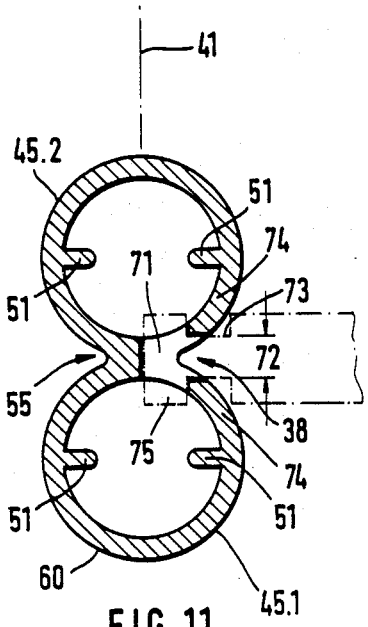
FIG. 11
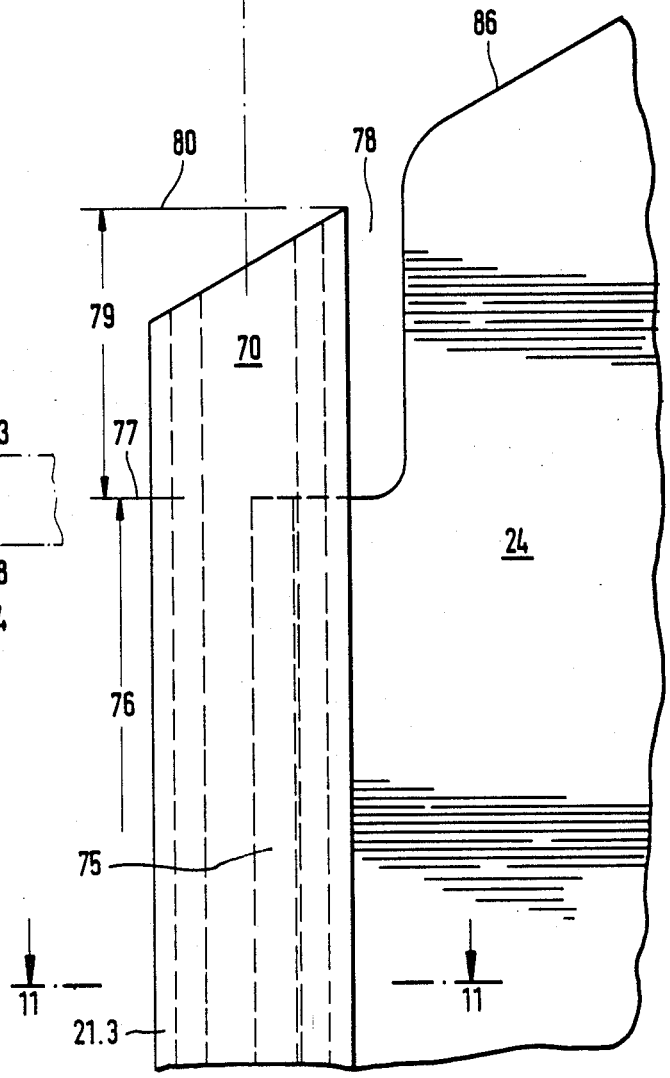

FIG. 22
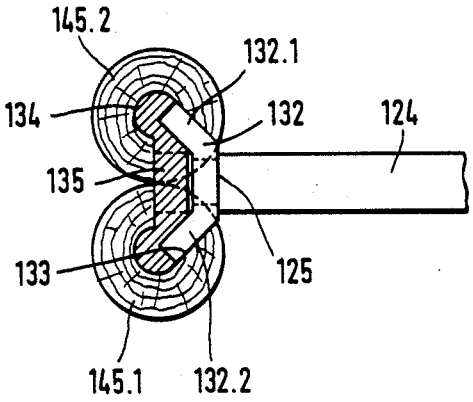
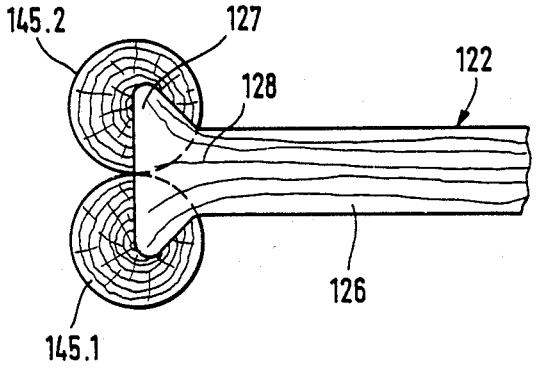
FIG. 18

FIG. 19
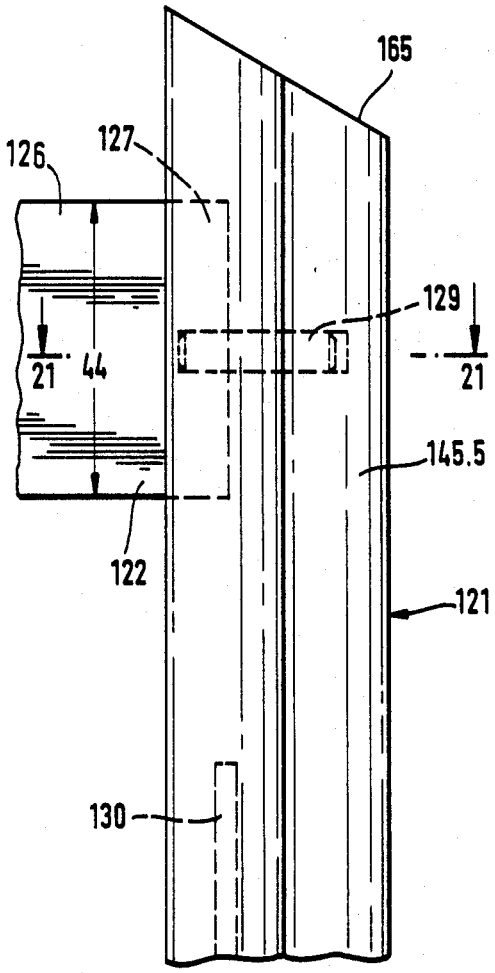
FIG. 20
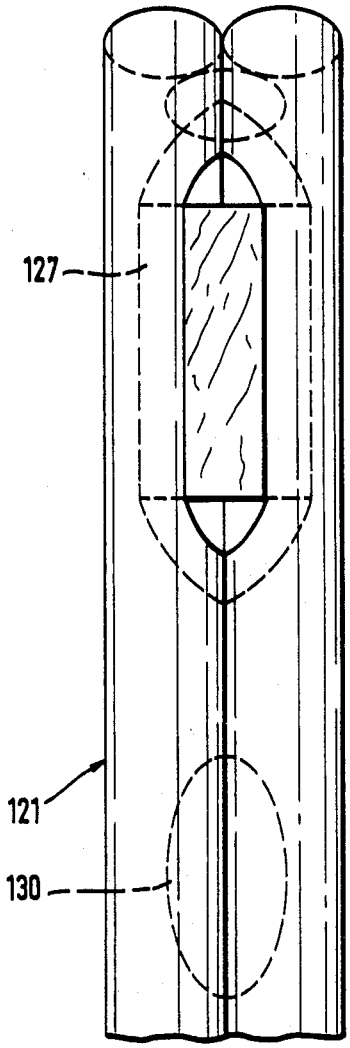
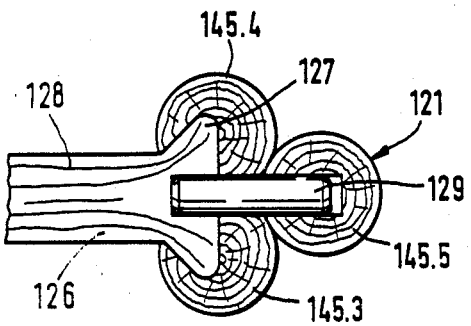
FIG. 21

CHAIR

BACKGROUND OF THE INVENTION

The invention concerns chairs of the type having four legs, a seat, a backrest, and a frame which carries the seat, the backrest being secured to the rear legs and, in particular, with the rear legs extending upwardly a considerable distance past the level of the seat.

Stated differently, the present invention concerns, and seeks by means of a rather fundamental change to improve upon, chairs of a certain general type. In this type of chair, the front and rear legs (and also in many instances visible crossbraces joining front legs, and/or visible sidebraces joining front and rear legs) form very essential parts of the chair frame, especially with regard to the frame's function of supporting the seat, with the ultimate design appearance of the chair being, to a very high degree, determined by the geometry of the frame, i.e., determined by the locations, dimensions, orientations, and relative positions of the front and rear legs, as well as of the cross- or sidebraces if such are present.

These types of chairs are extremely common in waiting lounges and waiting rooms, in business conference rooms, coffee shops, banquet halls, and the like. Extremely often, they are furthermore designed to be stackable.

For example, Fed. Rep. of Germany published patent application ("Offenlegungsschrift) DE-OS No. 32 24 812 discloses a chair in which the legs form a seat-supporting frame and are fabricated from specially profiled tubing which is bent into a certain configuration. Connector elements secured to this leg-frame then effect the actual mounting of the seat and backrest. The design possibilities associated with this particular construction technique offer various advantages, considered from the viewpoint of manufacture. On the other hand, the advantages regarding both design and manufacture are, clearly, tied in with the particular manner of use of such profiled tubing for the formation of the entire leg-framework, i.e., such as to cause the leg-framework to exhibit the requisite stability even at the locations where the constituent tubing has its bends. In other words, certain advantages regarding design and manufacture certainly result from the particular construction technique used, but the construction technique essentially predetermines the aesthetic design.

Some such "waiting room" chairs have legs which extend at least very generally said in a vertical direction, sometimes with the rear legs extending upward to a level considerably above that of the seat, in order to mount the chair's backrest. These are usually made of wood, of square steel tubing, or the like.

Especially, but not exclusively, in the case of chairs constructed of light-metal cast elements, it is a common practice that the left leg pair and the right leg pair each be in the form of a laterally attached inverted V-shaped member.

In another known construction, known to the assignee from having used it, a generally horizontal, four-cornered carrier element is provided at each corner with a mounting sleeve, the bottom ends of the mounting sleeves receiving inserted leg rods of circular section, sometimes with the top ends of these sleeve receiving inserted armrest elements and/or carrier elements for the backrest.

Each of these, and many other such constructions is for the most part directly associated with particular materials, particular manufacturing techniques, and result in chairs of a particular, corresponding appearance. Often, the particular construction employed is so determinative of the chair's final appearance, as to even determine or limit the extent to which color and color-combination effects can be provided and, likewise, determine or limit the particular materials, or especially combinations of materials, that can be used.

SUMMARY OF THE INVENTION

It is a general aim of the invention to provide a novel chair construction similar, in a very general sense, to the various types of "waiting room" chairs referred to above, but providing far greater freedom with regard to design and manufacture.

It is a further aim of the invention to provide a novel chair construction in which the general configuration or geometry of the chair frame determines, or predetermines, the final appearance and final structure of the chair to a far lesser degree than in prior art.

It is a somewhat more particular aim of the invention to provide a novel chair construction in which the general configuration or geometry of the chair frame determines, or predetermines, the final shape and appearance of, in particular, the seat and backrest to a far lesser degree than in prior art.

It is a further aim of the invention to provide a novel chair construction in which the configuration or geometry of the chair frame is determined by certain consistently employed structural principles, while yet allowing for considerable variation in the configuration or geometry of the chair frame itself.

A yet further aim of the invention is to provide a novel chair construction in which the chair legs can be formed by straight-extending, semi-finished elements, such as severed increments of metal tubing, solid wood rod stock, and the like, with these elements being capable of being very readily combined to form differing leg assemblies and frame assemblies, even including assemblies in which different ones of these elements are of different materials and/or colors, and with these elements of the leg and frame assemblies readily permitting use of a variety of sea and backrest shapes and types.

In accordance with a presently preferred concept of the invention, the chair has a frame which mounts the seat and backrest, with the frame being in part constituted by the chair's front and rear legs. The front and rear legs all extend approximately vertically, and the rear legs preferably extend upward a considerable distance past the seat level in order to mount the backrest at the lateral regions of the backrest. Most important, the frame further includes a very stiff hidden central underframe. This central underframe is located hidden beneath the seat and has, by way of preferred example, a generally rectangular shape defined by four horizontally extending side wall portions of which each extends roughly parallel to a respective one of the seat's front, rear, left-side and right-side edge regions, but each such side wall portion of the underframe being located horizontally inward of the respective edge region of the seat by a fair distance toward the central region of the seat, i.e., so as to in fact remain hidden, and with these four side wall portions of the central underframe each being of a height considerably greater than its transverse thickness, i.e., having a "standing on edge" orientation, in order to impart great stiffness to the hidden central underframe.

According to a presently preferred concept of the invention, the hidden central underframe has at each of its four corners a horizontally extending leg-connecting arm which projects outwardly away from the underframe, at least initially in the direction of a diagonal of the underframe, and extends toward one of the chair's four legs and, where it meets the leg, is joined to the leg. For reasons made clearer below, it can be advantageous that each such diagonally projecting leg-connecting arm of the central underframe project outward a fair distance past the respective corner region of the seat and be joined to the associated front or rear chair leg outwardly of such corner region of the seat, the end part of such arm and the chair leg to which it is joined thus being not hidden by the seat.

According to a further presently preferred concept, the main body of the hidden central underframe mounts and supports the seat, preferably with the seat spaced some distance above the central underframe, but, in contrast, the underframe's aforementioned diagonally projecting leg-connecting arms are not secured to nor even in contact with the seat but instead are cantilevered out from the main body of the underframe. As will become clearer below, this further contributes to the freedom with which the seat, and indeed the entire chair, can be designed.

Although a variety of leg configurations would fall within the broadest concepts of the invention, the embodiments illustrated herein employ legs each constituted by at least two continuous (i.e., longitudinally not interrupted) increments of straight rod stock, preferably of circular cross section, with the two (or more) leg rods of each leg running alongside each other, directly adjoining each other along their entire lengths. This can lead to various considerable advantages mentioned below that are, however, best to be understood in conjunction with the description, yet further below, of the preferred embodiments shown in the FIGS.

If, as just set forth, each chair leg is constituted by plural continuous leg rods of circular section which directly adjoin along their entire lengths, then lengthwise recesses are present to either side of the line of contact or line of junction that exists between each two adjoining leg rods. In that event, it is presently preferred that each plural-rod leg be joined to the associated outwardly projecting leg-connecting arm of the central underframe at the region of an inwardly facing one of the leg's lengthwise recesses, with the terminal part of the leg-connecting arm penetrating into such recess.

Utilizing appropriate ones of the above structural principles of the invention, the chair legs can be formed of continuous increments severed from rod stock whose diameter can be rather freely selected, without for example requiring any corresponding alteration in the dimensions or shape of the hidden central underframe. Certainly, in contrast to earlier-mentioned prior art, the legs need nt be of certain cross-sectional dimensions in order to be inserted into cylindrical mounting sleeves with exactly a predetermined degree of tightness of fit. Already in this respect, one is much freer with regard to the configuration and appearance of the chair. Indeed, legs of various cross-sectional configurations and dimensions can be used, without requiring alteration of the chair's hidden central underframe, without alteration of the underframe's outwardly cantilevered leg-connecting arms, and very often without alteration in the joining technique employed to connect the ends of those arms to the legs.

Related to the advantage of being able to more freely select the leg or leg rod diameter, is an increased freedom in selecting the material used for the legs or constituent leg rods, even to the extent of being able to use materials not customarily employed in the familiar types of such "waiting room" chairs. For example, use can be made of the particular bent-around, semi-finished leg stock disclosed in DE-OS No. 32 24 812; use can even be made of naturally grown rod stock, such as used in rattan and bamboo garden-room or patio chairs, if necessary combining a sufficient number of such naturally grown leg rods into a leg cluster, to form a leg of thick-enough aesthetic appearance and/or great enough strength.

Yet a further aspect should be noted, concerning the increased freedom in the choice of the leg or leg rod diameter. It can happen that the designer wishes to choose for the leg or its constituent rods a material which, when used in rod stock of a particular diameter, is strong enough for vertical-weight-bearing purposes but perhaps lacks some of the structural properties needed to impart sufficient overall stiffness to the chair frame as a whole. In accordance with an already mentioned, preferred concept of the present invention, the designer might wish to deal with this problem by increasing the number of leg rods that form the front and/or rear legs. Alternatively, however, the designer can increase the stiffness to the required degree, often with no increase of the total effective leg cross-section, by increasing the length of the line of junction between the leg and the end of the associated leg-connecting arm of the hidden central underframe. Preferably, the leg-connecting arms of the underframe are of one piece with the adjoining portions of the underframe, i.e., the portions to which the inner end of the outwardly projecting arm is connected and, preferably, the hidden central underframe, and the leg-connecting arms thereof, are severed increments of for example extruded profiled stock. In that event, the just-mentioned increase in the length of the line of junction between the leg and the leg-connecting arm can, in many instances, be achieved in a rather direct way, by merely severing longer increments of such underframe-forming profiled stock. As a result, the hidden underframe and its projecting leg-connecting arms will be taller, and thus the lines of junction between the legs and the leg-connecting arms longer, to produce the stiffness increase in question.

The use of legs each formed by at least two lengthwise directly adjoining, continuous increments of severed-off rod stock tends to lead to legs that are of greater strength than the slimness of their visual impression would suggest. In particular, the viewer visually focusses his attention more upon the slimness of the individual constituent rods of a particular leg, especially for example if they are differently colored, instead of perceiving the true, and of course greater, total cross-sectional dimension of the leg that these rods together form.

With the present invention, one departs in a particular sense from the prior-art approach, so often encountered in chairs of the "waiting room" type, of having all or almost all of the elements of which the chair frame consists be exposed to view. With the present invention, the front and rear legs, which do form parts of the chair frame, are exposed to view. However, the basic notions of what such a chair frame ought to be are so altered that the functions of imparting to the chair frame the requisite strength, stability and rigidity are, to a maximum degree, centralized in a hidden structure located below the seat, namely the already discussed hidden central underframe, with at most the end portions o its diagonally outwardly projecting leg-connecting arms being exposed to view. Because the hidden central underframe, i.e. the structure mot responsible for chair frame strength, stability and rigidity, is in fact hidden from view, the exact details of the means employed to connect together the legs and/or seat becomes a matter that can be decided rather freely, or even somewhat tentatively, e.g. in the case of a chair design that is, from the aesthetic viewpoint, in all other respects complete and determined. One simple example of this has already been given, namely: in order to increase frame stiffness, the replacement of one hidden central underframe with another which is of greater vertical height, but in all other dimensional respects unchanged, being merely a somewhat lengthier increment severed-off from the same source of extruded profiled stock. However, that is but one example, and numerous other such varieties of flexibility in aesthetic design and in construction likewise result with the inventive concepts.

Also, an important aspect relates to manufacturing cost and convenience, in the event that a particular design is to be modified, whether to further perfect it or for the creation of alternative commercial models, and a great number of examples concerning this aspect could be cited. As one example, if a decision is made to alter, even considerably, the shape of the seat, for example if the latter is a single contoured plywood or plastic element, it will often be a very fortunate fact that the seat is supported by and in contact with the hidden central underframe, and in contact with no other part of the chair frame. In other words, a change of configuration of the seat will often be possible without any change whatever in the dimensions, configurations, orientations and relative positions of the legs and the backrest. Thus, if one actually wishes to experiment with seats of differing configurations, one will often be able to do so to a great extent without worries concerning changes that might then become necessary regarding other elements of the chair, inasmuch as changes regarding the other elements will, very often, not become necessary. Similar advantages exist in the case where, for example, it is desired to experiment with a number of variations for the front legs of the chair, regarding perhaps their cross-section, the number of their constituent leg rods, the angle of their incline if they are not to extend exactly vertical, and so forth. Here again, the fact that the front legs are not responsible for mounting the seat, nor even in contact with the seat, and the fact that the seat is mounted and indeed contacted only by the hidden underframe, will often be factors of a most welcome character, in such an experimental situations.

Greater freedom and flexibility with regard to aesthetic design is not the only sort of freedom that can result with the inventive concepts. For example, presuming that one has already committed oneself to a particular aesthetic design, including all the dimensions, orientations, relative positions, shapes and structural materials of the visible elements, i.e., the front and rear legs, the chair seat, and the backrest, there still remain questions of cost and convenience as to manufacture and assembly. It may perhaps be that certain aesthetic decisions involving the cross-sectional configurations, or other aspects, of the front and/or rear legs raise questions concerning how the legs are to be secured to the projecting leg-connecting arms of the hidden central underframe, e.g., whether by welding, cementing, by means of dowel pins, combinations of such techniques, and so forth. If, for example, all of these joining techniques would be structurally adequate, one might wish to experiment with different ones of them, solely to determine which one would lead to easiest and cheapest manufacture and assembly. In such a situation, it again becomes advantageous that the structurally most important part of the chair frame, namely the hidden central underframe, is in fact hidden. Certainly, if large-quantity mass production is in question, the decision as to which of such joining techniques to use may be of great economic meaning. Accordingly, the possibility of modifying, even drastically, the dimensions and/or geometry of the hidden central underframe, in order to make possible the use of this or that joining technique, and furthermore without effect upon the aesthetic design to which one is firmly committed, is an advantage that may be of critical importance with regard to the question whether a chair of that particular aesthetic design can be manufactured and sold at a competitive price.

In one exemplary embodiments illustrated herein, the legs are formed of extruded aluminum tubing. "Aluminum" is here to be understood to refer not only to pure aluminum but also to aluminum alloys and other equivalent light metals. The use of extruded aluminum tubing for the legs can be a very advantageous way to implement various concepts of the present invention. It is to be noted that extruded aluminum tubing, despite its clear advantage of strength and light weight, cannot be readily bent, or at least not with reasonable production costs. Accordingly, aluminum serves as a fine example of a structural material that might not be capable of use in certain general types of "waiting room" chairs, but whose use places the designer in a position where he may avail himself of various concepts of the present invention that specifically concern the use of uninterruptedly straight chair legs of uniform cross section. For example, it will often be that a designer wishes to have slim, neat-looking legs not flawed by any visible discontinuities on their exterior surfaces, especially at about the height of the chair seat, i.e., in the general region where, in certain embodiments of the present invention the leg-connecting arms of the central underframe project to and are joined to the legs. In that event, however, precisely because of the characteristics of extruded aluminum tubing, it will become particularly meaningful to adopt the earlier-described joining technique, according to which the outer end of each leg-connecting arm penetrates into the earlier-mentioned inward facing one of the lengthwise recesses of the plural-rod leg and is joined to the leg there.

The chair's plural-rod legs can each be assembled from discrete, individual rods. However, especially for example when extruded aluminum tubing is used, it is advantageous to employ extruded twin tubing, i.e., a pair of tubular rods that are of one piece with each other. Such twin rods are easily produced, and they provide excellent strength and stability even when the individual rods of each twin rod are of comparatively small cross section and slim appearance. Also, they offer certain advantageous possibilities, which may be desired if the chair is to be provided with armrests. In particular, each armrest can be made of extruded single tubing, with the armrest-forming tubular rod extending for a part of its length generally horizontal in the customary location of a left or right armrest, but also extending for a considerable part of its length alongside the twin rods of a chair leg, received within the outwardly facing one of the two lengthwise recesses that the twin rod exhibits to either side of the line along which the two rods of the twin rods are joined. A clearer understanding of how this is done will be had from the description of the FIGS., further below.

The principle just mentioned is likewise employed in one preferred embodiment illustrated herein, in which the leg rods of the chair are 11 formed of extruded aluminum tubing, the rear legs being constituted by one twin rod, the front legs by one twin rod plus a single rod. In the same, just mentioned way that a certain length of an armrest-forming tubular rod runs along and is received within the outward facing lengthwise recess of a one-piece twin rod, here the single rod of a front leg also runs along and is received within the outward facing lengthwise recess of the front leg's one-piece twin rod. In such event, it is very advantageous to provide the single-tube rod of each front leg with a lengthwise extending external rib or projection configured to fit into and to a considerable degree fill the aforementioned lengthwise recess of the associated twin rod. This particular technique makes for easy assembly with very reliable and easy-to-establish positioning of the single rod relative to the twin rod and, furthermore, increases the strength and stiffness of each three-rod front leg, especially for example if this deep longitudinally extending engagement is yet more fully exploited by use of a sufficient number of connecting screws for the single and twin rod and/or by use of a long seam of cement or glue which, due to the presence of the single rod's lengthwise rib is able to establish cemented contact over a greater than otherwise possible percentage of the facing surfaces of the single and twin rods.

Advantageously, the leg rods are provided externally with longitudinally extending, circumferentially narrow, radially short, protective ribs, which are very easily produced on extruded tubular stock. These help to prevent scratching of the surface finish of the leg rods, especially for chairs of stackable design that will be repeatedly stacked and unstacked.

In principle, the ends of the outwardly projecting leg-connecting arms of the central underframe could be attached to the chair's front legs at the tops of the legs. Likewise, in principle, the backrest could be, at least in part, attached to the rear legs at the tops of the rear legs. However, such a technique of attachment would result in an excessive degree of predetermination of the particular manner of attachment between the front legs and the underframe's leg-connecting arms, and likewise in the particular manner of attachment between the backrest and the rear legs. In accordance with the present invention, it is instead preferred that the attachment to the front legs occur a fair distance below their top ends and, likewise, that the attachment of the backrest to the rear legs occur a fair distance below the top ends of the rear legs. This has certain advantages. First, there is again a further increase in design freedom, for example as between the height of the lateral edge regions of the backrest relative to the height of the tops of the rear legs. Also, the uppermost ends of the front and rear legs are not directly involved in such attachment, and thus are left free for other purposes. For example, in the case of tubular leg rods, capping plugs can be inserted into the upper ends of the front and rear legs for decorative effect, or the capping plugs may be designed additionally to help hold together the constituent tubular rods of each leg. Analogous remarks apply to capping members that might be used in the case where the leg rods are, for example, made of solid wood, and not of extruded tubular stock. Of course, capping plugs or capping members may also be applied to the bottom ends of the legs for either of the just mentioned two purposes.

The novel features which are considered characteristic for the invention are set forth in particular in the appended claims. The invention itself, however, will be best understood from the following description of preferred embodiments when read in connection with the accompanying drawing.

BRIEF DESCRIPTION OF THE DRAWINGS

FIGS. 1–12 depict a chair constituting a first exemplary embodiment of the invention, the chair legs here constituted by light-metal round tubing, wherein:

FIG. 1 is a front perspective view;

FIG. 2 is a front elevational view;

FIG. 3 is a back elevational view;

FIG. 4 is a side elevational view;

FIG. 5 is a top view;

FIG. 6 is a bottom view;

FIG. 7 is a cross-sectional view, taken on line 7—7 of FIG. 1, through a rear leg;

FIG. 8 a cross-sectional view, taken on line 8—8 of FIG. 1, through a front leg;

FIG. 9 is a top view, on a larger scale than FIG. 5, with the chair seat removed in order to expose to view the chair's hidden central underframe and, for the sake of clarity, with the mounting elements for the seat, and also the chair's backrest, likewise removed, the left half and part of the right half of the chair being shown, with the left front and left rear chair legs being shown sectioned along a horizontal sectioning plane located just above the underframe;

FIG. 10 is front detail view showing the upper left corner region of the chair's backrest, and showing a capping plug about to be inserted into the upper end of the chair's left rear leg;

FIG. 11 is a cross-sectional view, taken on line 11—11 of FIG. 10, through the left rear leg, the part of the backrest's left edge region that is inserted into this leg being shown only in dash-dot lines, clarity in the illustration; and FIG. 12 is an exploded perspective view of the right rear corner portion of the chair's hidden central underframe, shown attached to the partly depicted right rear leg of the chair, this view including the one of the four seat-mounting arms provided at this one of the four corner portions of the underframe as well as the associated one of four stacking peg structures used when ity of such chairs are stacked.

FIGS. 13–14 depict a variant of the first embodiment shown in FIGS. 1–12, differing therefrom in the provision of armrests, wherein:

FIG. 13 is a front perspective view; and

FIG. 14. horizontal cross-sectional view, taken along line 14—14 of FIG. 13.

FIGS. 15–22 depict a chair constituting a second exemplary embodiment of the invention, the chair legs here constituted by solid circular rod stock, wherein:

FIG. 15 is a front perspective view like FIG. 1;

FIG. 16 is a cross-sectional view, taken on section line 16—16 of FIG. 15 the chair's left rear leg;

FIG. 17 is a cross-sectional view, taken on section line 17—17, through the chair's left front leg;

FIG. 18 is a cross-sectional view, taken along the horizontal section line 18 of FIG. 15, through a location at which the left edge portion of the backrest is connected to the two circular rods of the left rear leg, the backrest being shown non-sectioned in order that reinforcing fibers embedded therein be clearly visible;

FIG. 19 is a front elevational view depicting the upper end of a front leg and the manner of attachment thereto of the leg-connecting arm of the chair's hidden central underframe, the seat and other suc being removed for clarity in the illustration;

FIG. 20 is a cross-sectional view, taken along section line 20 of FIG. 19, in which the three-rod leg of FIG. 19 is rotated by 90° compared to its FIG. 19 orientation relative the viewer, the end portion of the leg-connecting arm of FIG. 19 being shown in section, but without hatching, to permit clear depiction of the reinforcing fibers that are embedded in the material of such arm;

FIG. 21 is a cross-sectional view, taken along section line 21—21 of FIG. 19, with the leg-connecting arm of the chair's hidden central underframe again being shown non-hatched, to permit clear depiction of the aforementioned reinforcing fibers; and FIG. 22 is a cross-sectional view, taken along section line 22—22 of FIG. 15, through the chair's right rear leg and showing the manner in which the edge portion of the backrest is attached thereto.

FIGS. 23–24 depict a portion of a further chair that constitutes a third embodiment of the invention, this further chair chiefly differing from the first embodiment of FIGS. 1–12 in that the load-supporting members are elongated metal inserts and the constituent solid wood rods of the front and rear legs serve chiefly to hide t elongated metal inserts, wherein:

FIG. 23 is an exploded perspective view of a three-rod front leg and of the mounting elements used for attachment to the associated leg-connecting arm of the chair's underframe; and FIG. 24 is an exploded perspective view depicting a two-rod rear leg, the mounting elements that join the associated leg-connecting arm of the underframe to this leg, and the mounting elements that join the associated lateral edge region of the backrest to this leg.

DESCRIPTION OF THE PREFERRED EMBODIMENTS

Figure 1:
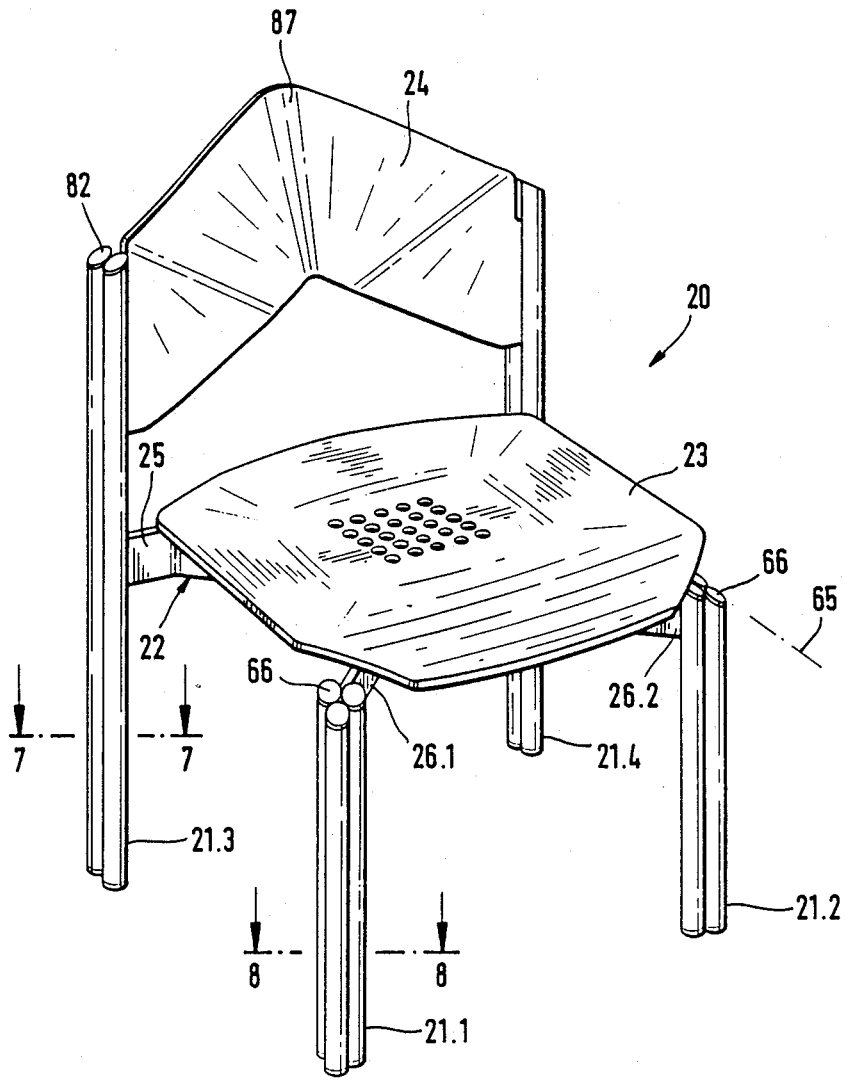

A first embodiment of an inventive chair is depicted in FIGS. 1–12. The chair 20 has front legs 21.1 and 21.2, rear legs 21.3 and 21.4, a hidden central underframe 22, a seat 23 and a backrest 24.

Seat 23 and backrest 24 are made of plywood worked to exhibit the desired contour.

The hidden central underframe 22 comprises a rectangular main part 25 (e.g. FIG. 6) having projecting leg-connecting arms 26.1, 26.2, 26.3, 26.4 which, together with the main part 25 form a single structural unit. At its corners, the main part 25 is provided with openings 27, here cylindrical through-bores, for seat-mounting elements.

Figure 6:
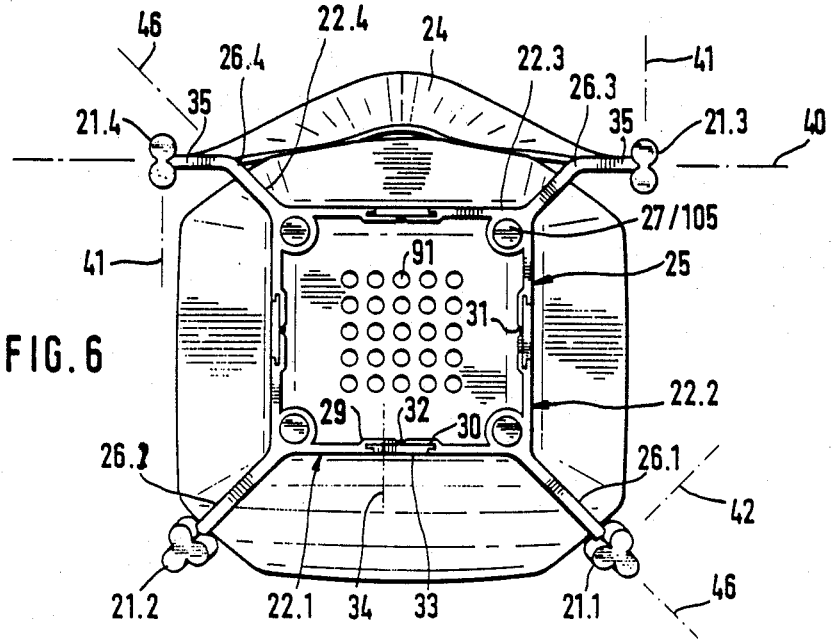
Figure 9:
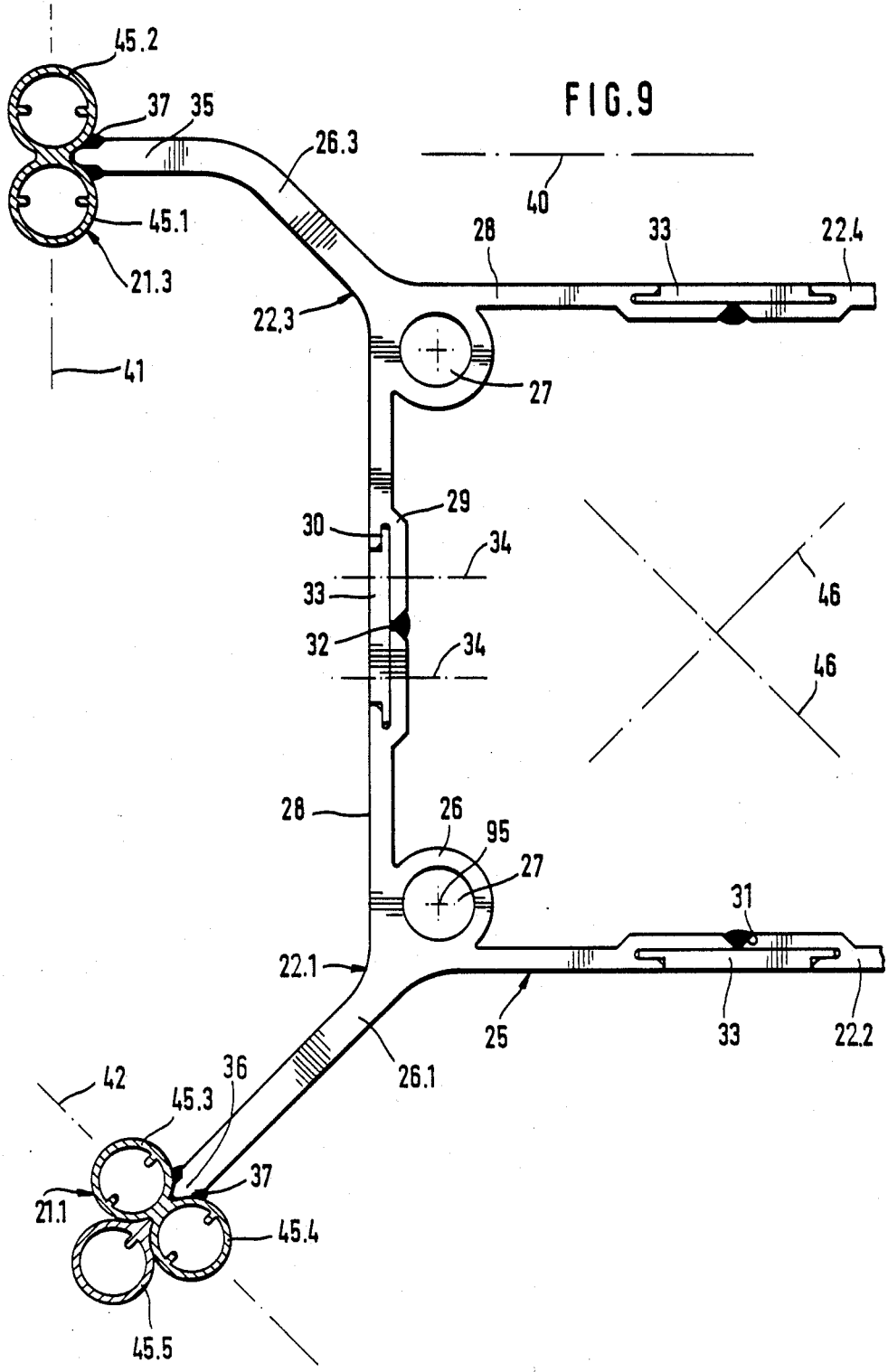

In this embodiment, and as shown in FIGS. 6 and 9, the method for manufacture of the hidden central underframe 22 is such that it be composed of four sub-units 22.1, 22.2, 22.3, 22.4. As best seen in FIG. 6, these four sub-units include a pair of identically profiled front sub-units 22.1, 22.2 and a pair of identically profiled rear sub-units 22.3, 22.4. In each instance, one of the two sub-units of a pair is mounted flipped-over relative to the other, so that the two of a pair be arranged mirror-symmetrical to each other. As best seen in FIG. 9, each of the underframe's profiled sub-units comprises two wall-forming webs 28 which extend perpendicular to each other and have thickened ends 29 provided with connecting slits 30 and, at 31, chamfered to accommodate a weld seam. As shown, cover plates 33 fit into the slits 30 and have outer faces flush with the outer faces of each two joined-together wall-defining webs 28. If need be, each such joint can be strengthened and/or stiffened by means of two (not shown) rivets each extending through one arm 28 and one end of cover plate 33, as indicated by the two broken lines 34 in FIG. 9. The underframe's sub-units 22.1, 22.2, 22.3, 22.4 are each of a height 44 (FIGS.4 and 12) and are formed as semi-finished elements, each being a severed-off increment, of a length equal to height 44, severed-off from lengthier, continually extruded profiled stock.

The underframe's front sub-units 22.1, 22.2 have leg-connecting arms 26.1, 26.2 each extending in the direction of one of the two diagonals 46 of the rectangular main part 25 of the underframe. The underframe's rear sub-units 22.3, 22.4 have leg-connecting arms 26.3, 26.4 each extending initially in the direction of one of the two mentioned diagonals until they reach a plane 40 within which they are to be joined to the respective rear leg, e.g. 21.3; subsequent to reaching this joining plane 40, each of these two leg-connecting arms bends outward to form a terminal arm portion 35. The ends 36 of all four leg-connecting arms 26 are first (as shown in FIG. 9) bilaterally tapered to become thereafter of reduced transverse width and simultaneously exhibit outwardly facing shoulders or grooves and then, at their extreme end portions, bilaterally chamfered. In this way, the end portions of the four arms 26 can be provided bilaterally with weld seams engaging these end portions over a surface area that is relatively large, considered transverse to the direction in which the weld seams extend, but with the weld seams themselves being all but hidden from view.

Figure 7:
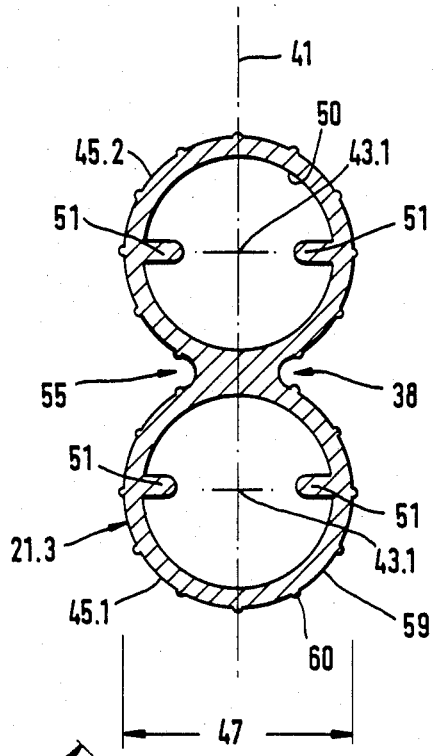
Figure 8:
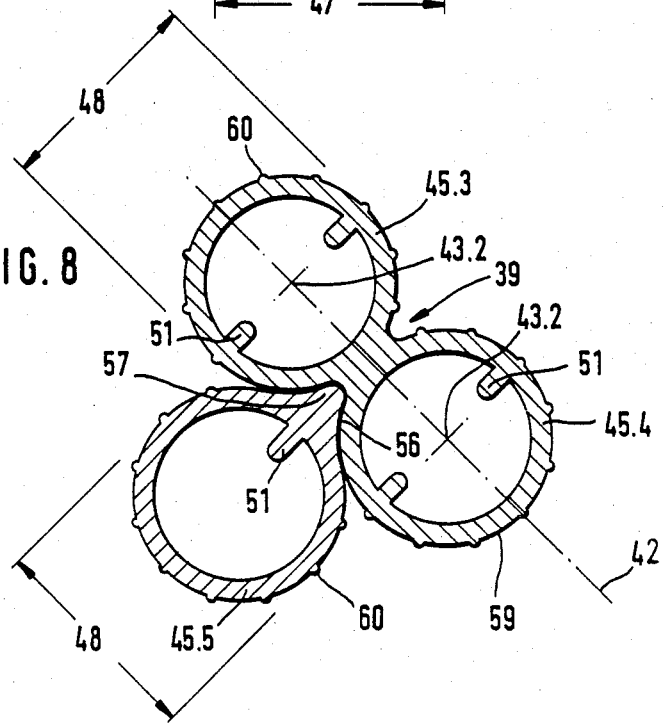

As best seen in FIGS. 7 and 8, each leg 21 comprises a cluster of tubular round rods. At each rear leg (FIG. 7) two adjoining rods together define an inwardly facing recess 38, and at each front leg (FIG. 8) two adjoining rods together define an inwardly facing recess 39, these recesses 38, 39 each receiving the narrowed end 36 of a respective one of the four leg-connecting arms 26. In this embodiment the legs 21 also are formed by severed-off increments of continually extruded profiled tube stock, here made of aluminum and can be attached to the ends of the leg-connecting arms 26 (see FIG. 9) of the hidden central underframe 22 by means of longitudinally extending weld seams 37. There results a stable chair frame made of welded-together extruded light-metal elements. The height 44 of the underframe 22, inclusive of its leg-connecting arms 26, can be selected in dependence upon the required structural stiffness and in accordance with the intended design. Various sorts of increased freedom regarding the chair's aesthetic appearance result from the fact of the all-light-metal construction, and from the fact that the visible elements of the chair frame can always be composed of thin-silhouette elements and especially from the fact that the seat- and backrest-supporting chair frame can be made self-supporting per se so that seats and backrests of very various configurations can be secured to it, with the strength, stability and stiffness of the chair frame not essentially depending upon its connection to the seat and backrest elements, and certainly not essentially depending upon its connection to seat and backrest elements of particular shape.

In this embodiment the legs are composed of clusters of round stock providing a slim, elegant appearance, using a relatively small mass of material and nevertheless having excellent stability characteristics. Whereas the rear legs are formed by two circular rods the front legs are formed by three. Each of the rear and front legs includes a one-piece extruded rod-pair shaped like a rifle's twin barrel. As shown in FIG. 7 for a rear leg, the longitudinal axes 43.1 of the two round-rod portions 45.1, 45.2 of the respective rod pair together define a plane of juncture 41 extending perpendicular to the earlier-mentioned connection plane 40 (FIG. 9) that joins the two rear legs. In contrast, for each front leg 21.1 or 21.2, the longitudinal axes 43.2 (FIG. 8) of the two leg rods 45.3, 45.4 that face toward the central underframe 22 together define plane of juncture 42 which extends at 45° to each of the aforementioned planes 40 and 41 and perpendicular to a respective one of the two diagonals 46. All the leg rods are of the same circular, tubular configuration but have slightly differing diameters 47 (FIG. 7) and 48 (FIG. 8). The diameter 48 of the three front leg rods 45.3, 45.4, 45.5 is somewhat smaller than the diameter 47 of the leg rods 45.1, 45.2 of the rear legs 21.3, 21.4. Such a difference in rod diameter between the three-rod front legs and the two-rod rear legs produces, aesthetically, an overall visual impression that is balanced, convincing and pleasing while not failing to take into account requirements as to structural stability. With the particular design shown in FIGS. 1–12, diameter 48 and diameter 47 might respectively amount to 24 mm and 27 mm, as an example. The twin-tube round rods 45 of each rear leg (FIG. 7) and of each front leg (FIG. 8) are provided at their interior walls 50 with pairs of diametrically opposite, inwardly projecting ribs 51 which occupy planes extending perpendicular to plane 41 in the case of the rear legs, and which occupy planes extending perpendicular to plane 42 in the case of the front legs. These ribs 51 are provided for reinforcing purposes, and also to help position certain inserted capping plus described further below. Between the two tubular round rods 45.1 and 45.2 of a rod pair, and likewise between 45.3 and 45.4, longitudinally extending slots or recesses are formed, denoted by 38 and 55, and by 39 and 56, respectively. The regions of the more inwardly located such recess, 38 in the case of the rear legs, 39 in the case of the front legs, receive the tapered and chamfered ends 36 of respective ones of the four leg-connecting arms **26.*n*. In FIG. 8, the single-tube round rod 45.5 of the shown right front leg (and likewise that of the left front leg) is provided on its internal wall with a radially inwardly extending longitudinal rib 51 of its own and, on its external wall, is provided with a radially outwardly extending longitudinal rib 57 angularly coincident with the internal rib 51. Longitudinal rib 57 is of roughly triangular cross section, with the vertex thereof most removed from the center of rod 45.5 being acute and configured to fit into the outwardly facing longitudinal recess 56 formed by the rod pair 45.3, 45.4. Rib 57 helps to exactly position the single- and twin-tube rods of the front leg relative to each other all along their lengths and to increase the stability and stiffness of their combination with each other. Also, the volume of material constituting rib 57, and/or the increase of surface area provided by rib 57** may be helpful, depending upon the technique used for joining the single- and twin-tube rods, for example in the case of the use of connecting screws or in the case of a glue or cement connection.

The external surfaces 59 of all round rods 45 are provided with thin, slightly projecting, preferably half-cylindrical protective ribs 60 spaced one from the next by a suitable angle, for example extending longitudinally in planes that form 45° angles with one another.

As shown in the FIGS., the legs are formed continuous, of one-piece round tubular stock, having no interruptions or discontinuities along their lengths. The leg-connecting arms 26.3 and 26.4 are secured to the rear legs 21.3, 21.4 about half way up these legs, so that a suitable height for the seat can be established. The front legs are configured in a manner which does not merely correspond to the particular aesthetic design but which furthermore is advantageous for manufacture and assembly. Their upper limit 62 (FIG. 4) extends upward beyond the top edge 64 of the hidden central underframe 22 by a distance 63. At all heights above the level of top edge 64, the upper ends of the front legs 21.1, 21.2 slant downward and outward, along respective slant planes 65 exhibiting the same angles of declination in both the front-to-rear and side-to-side directions, the slant resulting from correspondingly slanted severing of the tubular rod stock. Suitable capping plugs 66 are inserted into the slanted top ends of the front legs' constituent tubes, the capping plugs 66 being so shaped that when in position their top faces exhibit the same downward and outward slant. At the parts of the capping plugs 66 that actually enter into the tubular stock, the plugs are provided with some suitable conventional holding means, causing the plugs to tightly (and preferably non-removably) engage the inner peripheral surfaces of the tubular rods and furthermore engage with the ribs 51 in a manner preventing plug rotation. Reference may be had to FIG. 10, which depicts similar capping plugs 82 for the top ends of the rear legs, the plugs 82 being provided with expansion arms 81 angularly separated by spaces that can and do engage the internal ribs 51; such plugs 82 can likewise be employed as the capping plugs 66 for the front legs, but without the portions 84 thereof, whose purpose for the rear legs is described further below. There thus results a completely smooth-surfaced, continuous leg configuration, with the longitudinal weld seams 37 (FIG. 9), which join the four legs to the four leg-connecting arms 26 of the hidden central underframe 22, facing inward and thus being all but hidden themselves, and with the legs having no corners, burrs or ridges on which garments could become caught.

The leg bottoms are provided with inserted floor-glide plugs 67, 68 (FIG. 4), these being of suitable cross-sectional outline (cf. FIG. 6, where the leg bottoms are seen from below). These plugs 67, 68 additionally serve, in the case of the front legs 21.1, 21.2, to help hold together the two tubular rods, one single and one twin, of which each front leg is composed. Preferably, the floor-glide plugs are made of a suitable synthetic plastic, to avoid damage to flooring materials.

FIGS. 10 and 11 depict the manner in which the backrest is mounted, FIG. 10 being a front view of part of the backrest 24 and of the attachment of its left edge region to the left rear chair leg 21.3, a capping plug 82 for the top end of leg 21.3 being shown ready to be downwardly inserted; and FIG. 11 being a section, taken along line 11—11, through the left rear leg 21.3.

The upper end of the left rear leg 21.3, in the vicinity of its inwardly facing lengthwise recess 38, is provided over part of its length with a longitudinal slit 71, best seen in FIG. 11, and formed by machining, e.g. milling. As shown in FIG. 11, longitudinal slit 71 has a transverse width which exteriorly is of the valu 72 and interiorly is of a greater value such that the slit 71 transversely extends all the way from the hollow interior of one tubular portion 45.1 to that of the other 45.2. As seen in various views, but best in FIG. 10, the left top corner of the plywood backrest 24 has a cut-away portion or cut-out 78, the cut-out having a horizontal edge and a vertical edge. (The right top corner is provided with a matching cut-out.) In FIG. 11, the left edge portion of the part of seat 24 below the horizontal edge of cut-out 82 is illustrated in dash-dot lines. As shown, in the region of the boundary wall portions 74 of lengthwise slit 71, the left edge portion of seat 24 is reduced in thickness to thickness value 72 by provision of vertical slots 73 on its front and back faces, whereas the terminal part 75 of this left edge portion is of full thickness. In this way, terminal part 75 can be pushed lengthwise into slit 71 from above. The height 76 (FIG. 10, also FIG. 3) of the left edge portion of backrest 24 and the vertical depth to which the lengthwise leg slit 71 downwardly extends from the leg top are dimensionally related to each other. In particular, the horizontal edge 77 of the lateral cut-out 78 is located a distance 79 below the upper limit 80 of left rear leg 21.3. (It will be understood that equivalent relationships apply at the right rear leg 21.4 and the right corner of backrest 24.) As a result, above edge 77 the interiors of tubular portions 45.1 and 45.2 (FIG. 11) are left free to receive the expansion arms 81 of the shown capping plug 82. Plug 82 has one generally circular set of lengthwise extending expansion arms 81 that enters tubular portion 45.1 and another such set that enters tubular portion 45.1 and, at its top, has a twin cap 83 to close off the tops of both tubular portions and form a single capping face. Additionally, plug 82, between its two sets of expansion arms 81, has a downwardly extending slit-filling portion 84 configured to enter slit 71 and, in an externally neat manner, close up the clearance, of transverse width 72, between the boundary wall portions 74 of slit 71. In addition to this cosmetic purpose, the slit-filling portion 84 in a structural sense bridges the two boundary wall portions 74 and to a considerable degree restores the effect of the original continuity between them. As a result, when a sitter leans back against the backrest 24, there is almost no tendency of the slit boundary wall portions 74, especially above the horizontal edge of cut-out 78, to yield and bend. Contributing in particular to such resistance is the ability of the slit-filling portion 84 to effect transmission of such bending or deforming loads to the relatively nearby longitudinally extending reinforcing ribs 51. The capping plug 82 is in its entirety a one-piece element. When plug 82 is in inserted position, the plane of its upper face 85 coincides with the plane of the inclined top edge face 86 of the left half of the backrest 24, this top edge face 86 extending upwardly inclined all the way to the peak 87 (FIG. 1) of the backrest. The peaked configuration for backrest 24 assures that sufficient back support for a sitter will be provided even if the chair's rear legs do not extend a great distance upward past seat level.

The contoured plywood seat 23 is at its deepest, central region 90 (FIG. 5) provided with a plurality of apertures 91 which drain off water after washing, disinfection, or the like, and also enable the sitter's clothes to breathe. At its underside 92 (FIG. 2) seat 23 is provided with left and right front mounting spacers 93.1 and (FIG. 3) with left and right rear mounting spacers 93.2. The top end surfaces of these mounting spacers can be of a shape exactly complementary to the portions of the seat underside 92 at which they are to be attached. Alternatively, the seat underside 92 can be provided with blind bores that receive such top ends. If the surface of the seat underside 92 at the attachment locations is such that mounting spacers 93.1 and/or 93.2 cannot have flat horizontal top faces, but instead must have inclined or even contoured top surfaces, then the inner end faces of such blind bores can be likewise not horizontal and flat but, for example, of a contoured shape and/or planar inclination corresponding to the top surfaces of the respective mounting spacers. In either case, it is presently preferred that the top ends of the mounting spacers 93.1, 93.1 be glued or cemented to the seat underside 92 at the locations of attachment to the latter.

Figure 12:
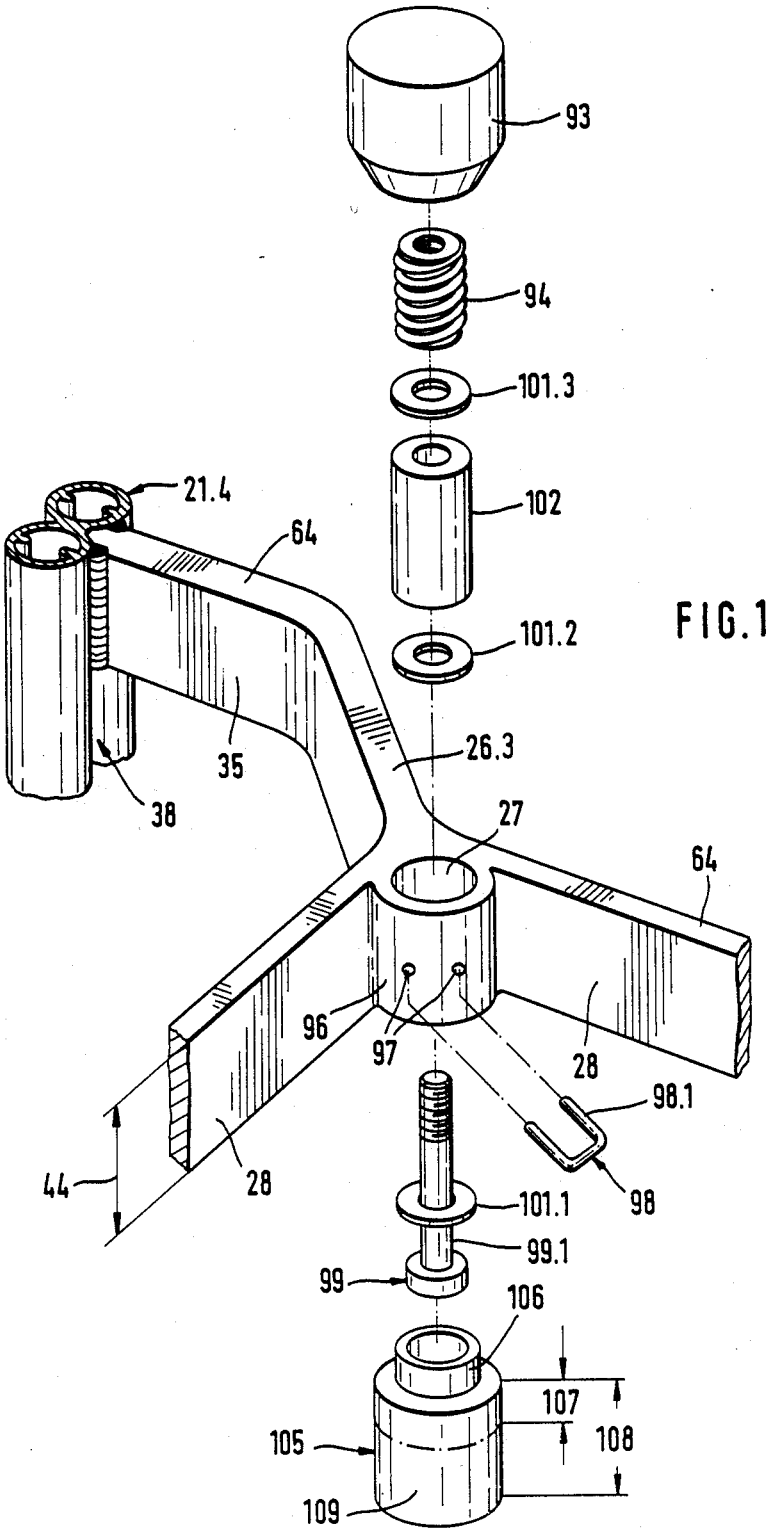

Each mounting spacer, generically denoted by 93 in FIG. 12, is provided with an externally and internally threaded socket joint 94. Socket joint 94 is screwed into a threaded bore open at the bottom end of mounting spacer 93. The mounting spacers 93 are in this embodiment cylindrical, and each has a longitudinal axis which coincides with the longitudinal axis 95 (cf. FIG. 9) of a respective one of the four mounting bores 27. The inward facing wall 96 (FIG. 12) of each mounting bore 27 is provided, axially midway its ends, with two small horizontal through-holes 97 spaced a small angular distance from each other and receiving the two legs 98.1 of a small U-shaped washer-positioning clip 98 made for example of round wire. The distance between the two clip legs 98.1 is a bit greater than the diameter of the shank 99.1 of a mounting and tightening bolt 99. The bolt 99 is provided with a washer 101.1 and is pushed upward into mounting bore 2 until washer 101.1 becomes upwardly braced against clip 98, and the head of bolt 99, in turn, becomes upwardly braced against washer 101.1. A further such washer 101.2 is dropped from above into mounting bore 27, where it comes to rest atop the legs 98.1 of clip 98. A spring member 102 is then pushed from above into the upper end of mounting bore 27 until the bottom end of spring member 102 comes to abut against washer 101.2, the spring member 102 here being cylindrical with a central longitudinal bore and being made of rubber or a rubber-like synthetic plastic material. The length of spring member 102 is so chosen that after insertion it projects a sufficient distance upwardly beyond the upper face 64 of underframe 22. A third washer 101.3 is provided at the top end of spring member 102, to separate the latter from the bottom end of the socket joint 94 and/or of the mounting spacer 93, to prevent digging into and eating away of the material of the upper end of spring member 102. The head of mounting bolt 99 is preferably recessed to be turned by an hexagonal wrench, or the like. When all four bolts 99 are threaded into the four associated socket joints 94 and then tightened, the seat 23 becomes mounted. By tightening the four bolts 99 to a greater or lesser degree, one can adjust the degree of springiness with which the seat 23 is elastically supported. Also, as four bolts 99 are present, one can tighten them to different respective degrees and thereby adjust the initial or unloaded forward or rearward inclination of the seat 23 as a whole. For example one can decrease the elasticity of the supporting action for the front or else the rear part of the seat, and simultaneously impart an increased degree of forward or rearward seat inclination, by extra tightening of the front or of the rear mounting spacers 93.1 or 93.2. The limit of such tightening is encountered when a spring member 102 becomes so compressed that the bottom end of the associated mounting spacer 93 can be drawn downward no further because of the obstruction presented by the upper face 64 of underframe 22. Alternatively, the pre-compression of the front and/or rear spring members 102 may be so selected that, when a sitter sits down, the front or rear part of the seat initially yields elastically but so greatly compresses the spring members 102 that, after the sitter has fully seated himself or herself, the seat 23 is non-elastically supported. Other such variations are possible, of which many will each produce a different characteristic "feel" when one is in the act of sitting down and/or thereafter remaining seated.

Figure 4:
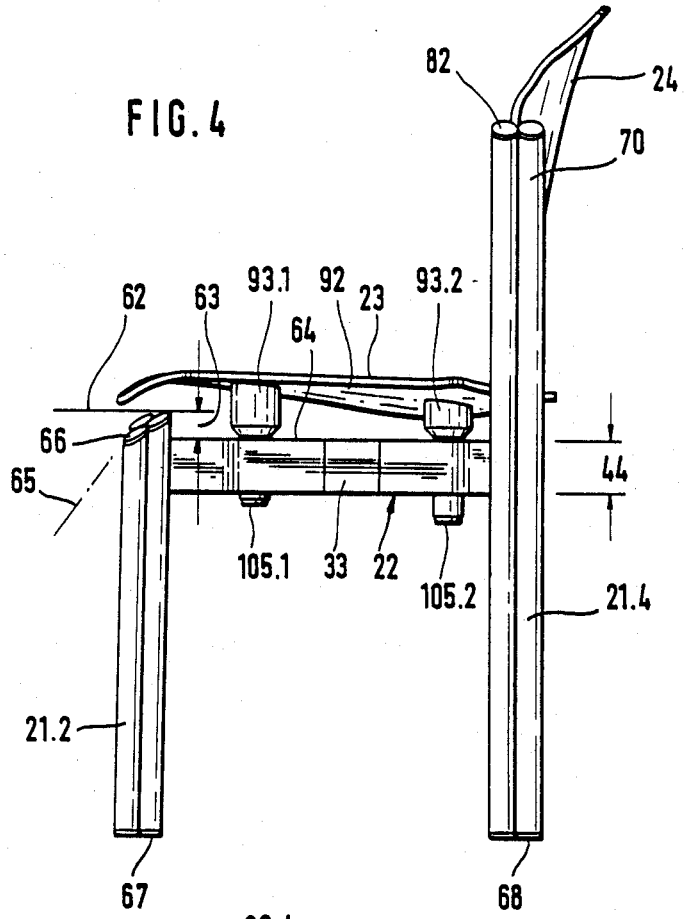

After the mounting bolts 99 have been inserted and tightened, stacking pegs 105 are inserted into the bottom ends of the mounting bores 27. These are provided so that a plurality of identical chairs may be stacked. As best seen in FIG. 4, the front and rear stacking pegs 105.1 and 105.2 are respectively of lesser and greater lengths, denoted by 107 and 108 in FIG. 12 so that they take into account the differing heights of the locations at which they will contact the top of the seat of the chair directly beneath them in the stack. t their top ends they have smaller-diameter male portions 106 which fit into the bottom ends of the mounting bores 27, and beneath portions 106 are their larger-diameter, actual peg-forming portions 109.

Figure 5:
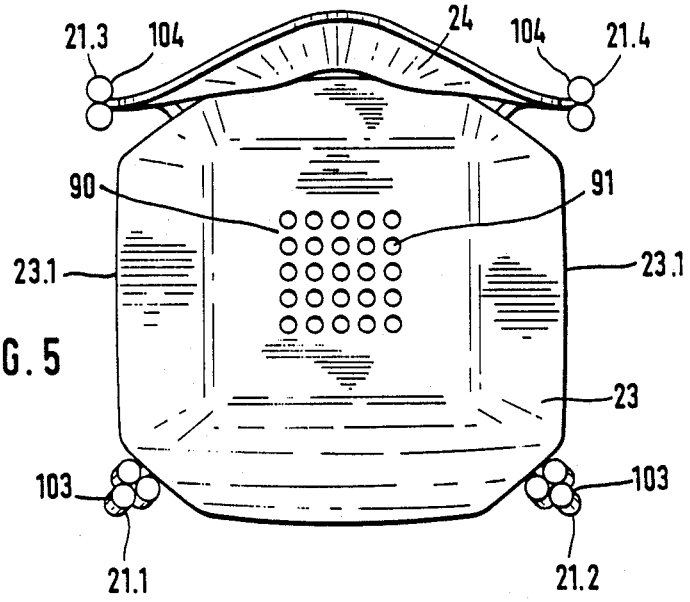
Figure 2:
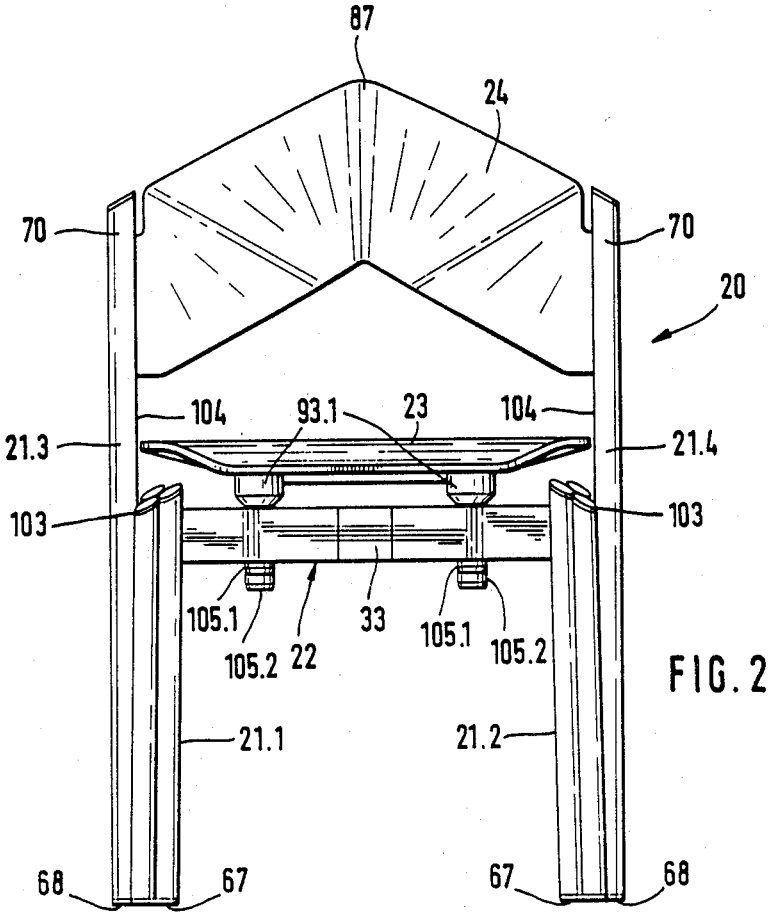
Figure 3:
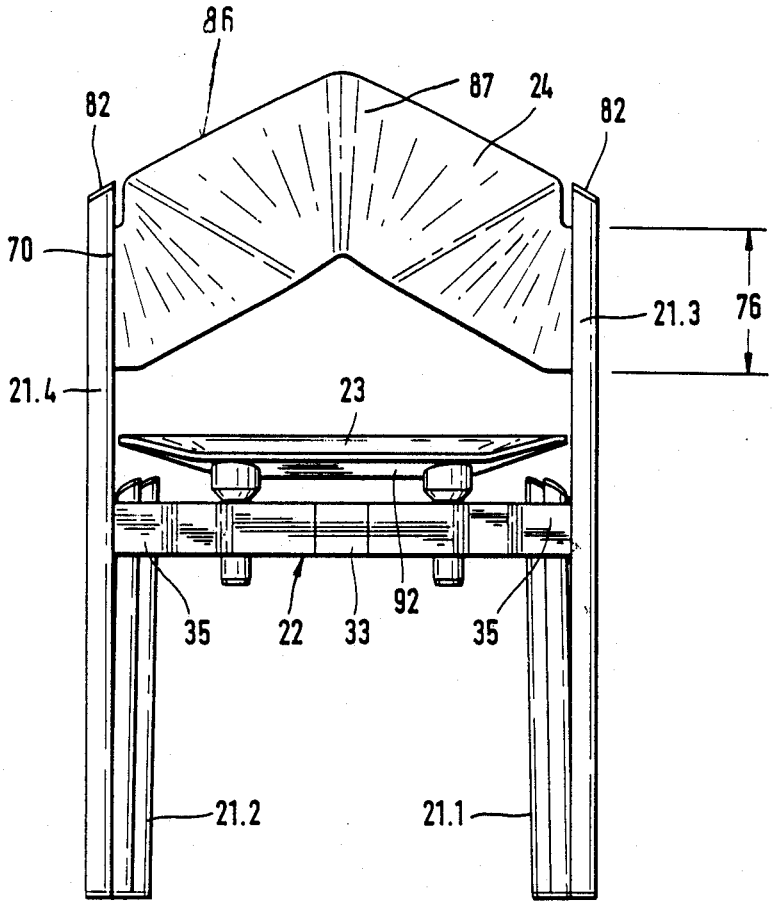

As can be seen in FIGS. 2, 3, 5 and 6, the two front legs 21.1, 21.2 are not vertically oriented. Instead, proceeding down from their tops to their bottoms each extends somewhat outwardly, the degree of this inclination being easiest to see in the FIG. 2 front view, and also being shown in the FIG. 4 side view where the degree of inclination is the same. In FIGS. 2 and 5, numeral 103 denotes the outermost locations of the top end of each front leg 21.1, 21.2. As best seen in the FIG. 2 front view, these top-outermost locations 103, approximately coincide with the laterally innermost edges 104 of the rear legs 21.3, 21.4, which in turn approximately coincide with the laterally outermost portions 23.1 (FIG. 5) of seat 23. If a plurality of identical such chairs are stacked atop one another, the two rear legs of a particular chair will just graze, or be slightly spaced from, the lateral edges 23.1 of several of the chairs beneath such chair. Also, the two rear legs of a particular chair in the stack will be, of necessity, located forward of the two rear legs of the chair directly beneath. Accordingly, as the height of the stack grows it will have a tendency to exhibit a forward slant. In order that the stack of chairs not forwardly collapse during storage or transport, some means should be provided to raise the bottoms of the front legs of the bottommost chair to an appropriate height above the bottoms of the rear legs of the bottommost chair, for example shim-like members securely but removably attachable to the bottoms of the front legs, or a rearwardly and downwardly slanting pallet or dolly attachable to the four legs of the bottommost chair, or some other means more or less elaborate than that.

Figure 14:
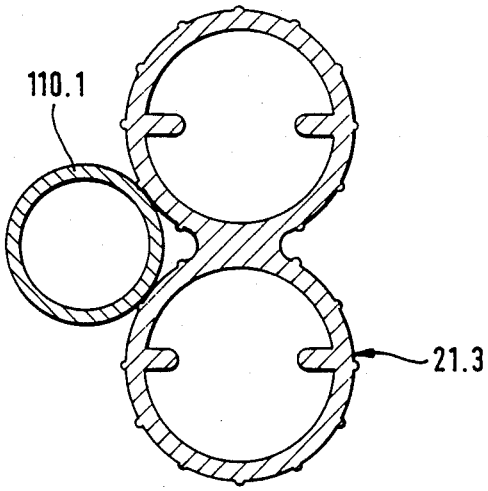
Figure 13:
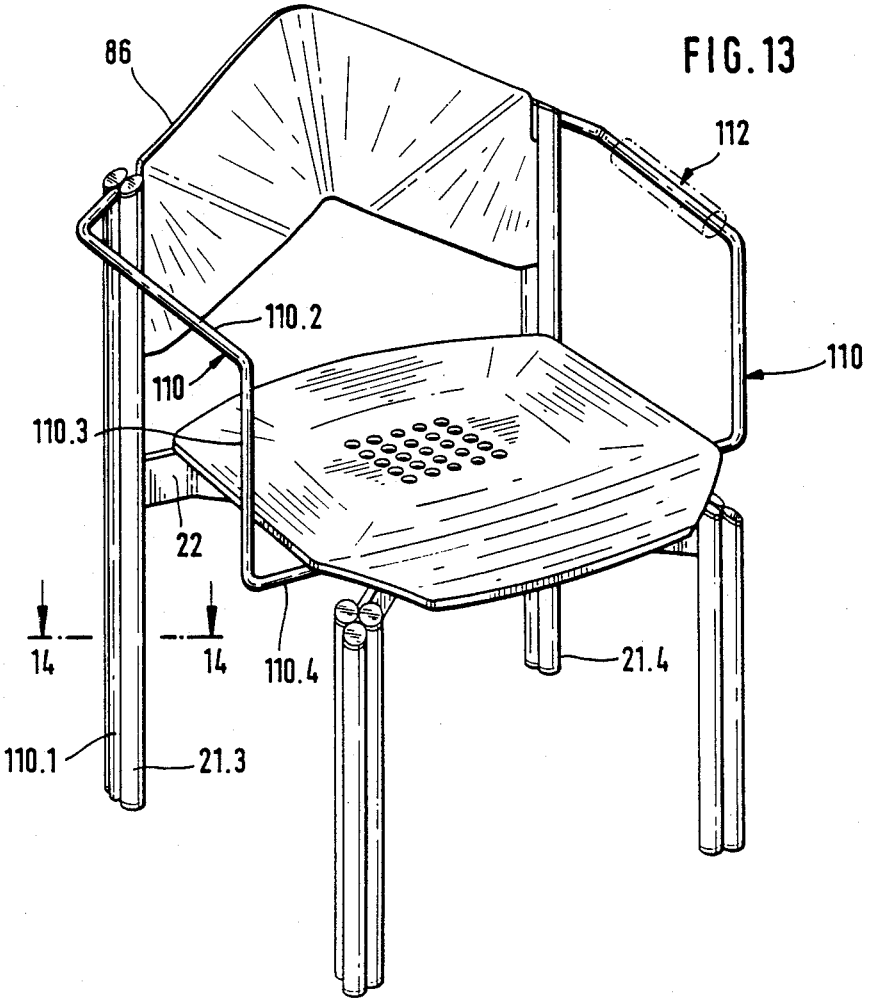
Figure 16:
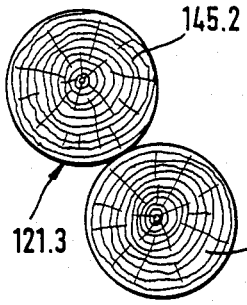
Figure 17:
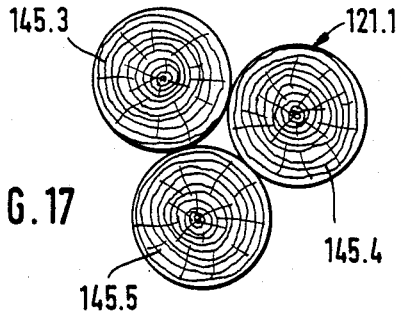
Figure 15:
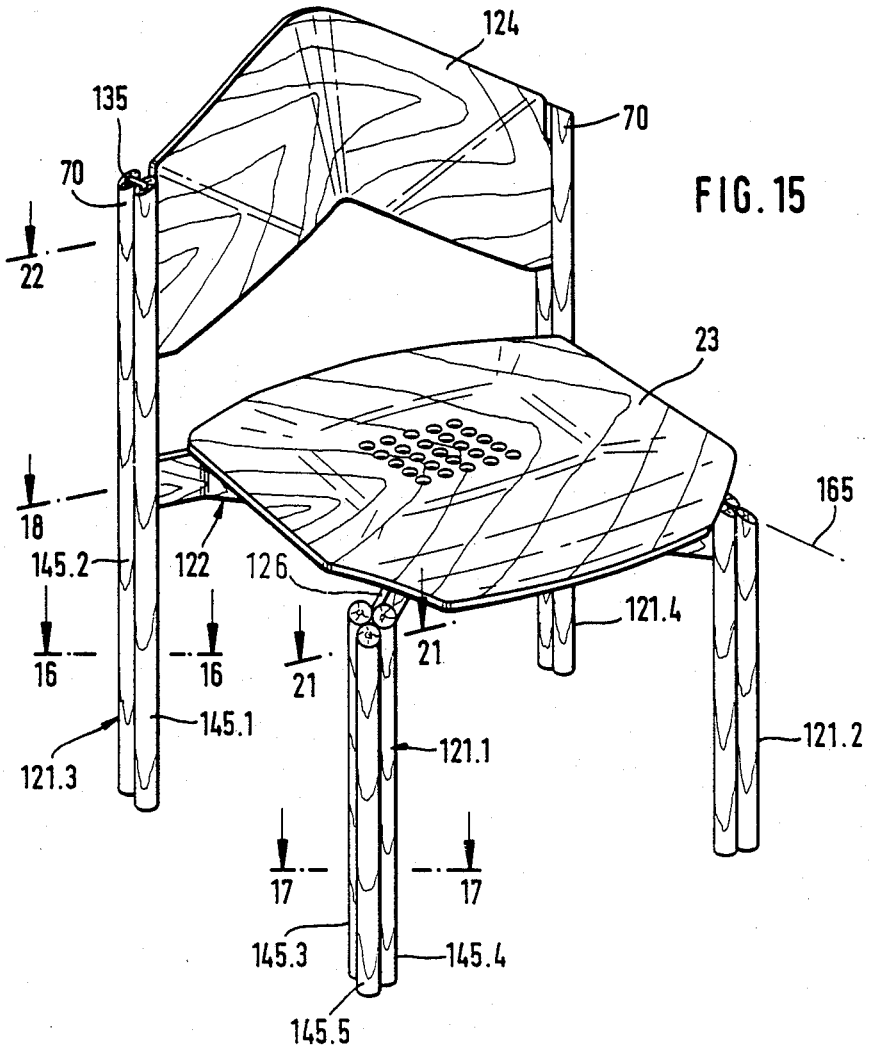

A chair such as depicted in FIGS. 1–12 can be provided with armrests, as shown in FIG. 13 where armrests 110 are attached at either side. Each round-rod armrest 110 includes: an upwardly extending, vertical rod interval 110.1 running alongside the respective rear leg 21.3 or 21.4 (cf. FIG. 14) and being of a length roughly equal thereto; followed by a short bent-down and -forward interval whose direction of elongation roughly coincides with that of the upper edge face 86 of the backrest; followed by an armrest interval 110.2; in turn followed by a bent-down, vertically extending front interval 110.3; and thereafter followed by a bent-inward horizontal interval 110.4 which extends to and ends at a (not shown) location beneath seat 23, at which it can for example be secured to the hidden central underframe 22 by (not shown) mounting flange, or the like. The long vertical interval 110.1 of each round-rod armrest 110, running alongside the respective twin-rod rear leg 21.3 or 21.4 (cf. again FIG. 14), may be secured thereto by e.g. welding, as before, i.e., retaining the basic design concept used in this embodiment, namely of combining round-rod elements into clusters and, more specifically, in the case of a twin and a single round-rod, securing the latter along the length of the former at the longitudinal recess formed along the length of such twin-rod, with the single rod being transversely inserted into such longitudinal recess as deep as it will go. The armrest interval 110.2 can be provided with a forearm- and elbow-supporting element, such as an attached-on hard flat elbow support or a padded elbow support or, as indicated in dash-dot lines at the right of FIG. 13, with a tubular elbow support 112.

The embodiment shown in FIGS. 15–22 is a chair of similar design which,, however, is formed with solid wood legs. Parts entirely corresponding to those of the embodiment of FIGS. 1–12 are denoted by the same reference numerals here as there; parts generally corresponding to those of the aforementioned embodiment but modified in view of the use of solid wood legs are denoted by the earlier reference numerals, increased by 100.

The hidden central underframe 122 in this embodiment is made of wood and, in particular, in accordance with the modern technique of fabricating cast bodies of resin-bound wood particles, with long fibers of reinforcing material such as suitable high-tensile-strength plastic embedded therein. Its overall configuration is the same as in FIGS. 1–12 except that, as shown in FIG. 21, its leg-connecting arms 126 terminate in dovetail-shaped thickened portions 127 into which the elongated fibers 128 extend. Each front leg 121.1, 121.2 is composed of three solid cylindrical wood rods 145.3, 145.4, 145.5, and each rear leg 121.3, 121.4 of two such wood rods 145.1, 145.2. As shown in FIGS. 18 and 21, the leg rod pairs 145.1, 145.2 and 145.3, 145.4 are each provided with recesses complementary to the dovetail shape of the end portions 127 of leg-connecting arms 126. As indicated in FIGS. 19 and 20, these dovetail-complementing recesses have a length corresponding to the height 44 of the hidden central underframe 122. One half of the dovetail-shaped end 127 of each arm 126 can be inserted and glued into the first, and then into the other, of the two rods of such a leg rod pair. In the case of the front legs, having a third leg rod 145.5 (FIG. 21), the latter is secured to the dovetail-shaped end 127 of the ZARGEN's leg-connecting arm 126 by means of a dowel pin 129, as shown in FIGS. 21 and 19. In the remaining regions along the lengths of the leg rods, e.g. 145.3, 145.4, 145.5 in FIGS. 19–21, connections between the leg rods 145.3 and 145.4; 145.3 and 145.5; and 145.4 and 145.5 can be, by way of example, established using further dowels, whether round dowel pins like the already mentioned pin 129 of FIGS. 19 and 21, or disk-like dowel plates 130 shown in FIGS. 19 and 20 connecting together the leg rods 145.3 and 145.4. As can be seen, here likewise the tops of the legs project upwardly beyond the tops of the leg-connecting arms 126 of the underframe 122 and present a continuous, i.e., uninterrupted, straight and smooth image. End caps equivalent to the capping plugs in the embodiment of FIGS. 1–12 are not here used, so that the end grains at the slanted upper end faces 165 remain exposed to view, presuming that one does not for example employ decorative opaque lacquer, or the like. It may be that one will desire to impart different colors to the constituent leg rods, to create pleasing color combinations and/or to cause the three-rod front-leg rod clusters to seem slimmer than they are. In that event, the individual constituent leg rods of the rear as well as the front legs can be coated with a colored opaque lacquer before any assembly thereof into rod clusters. The mounting of the backrest 124 can in principle be performed in the same way as in the embodiment of FIGS. 1–12, in particular as shown in FIGS. 10 and 11, even with the lateral edges of the backrest deeply gripping through into the material of the rods of the rear legs. That, however, could result in weakened locations between the rear leg rod pairs when these are, as here, made of wood. Accordingly, the embodiment according to FIG. 22 provides at the vertical limits 125, a member 132 made of flat metal, e.g. aluminum, or steel bent to have a dovetail shape and attached endface-to-endface with the edge face of seat 124 by means of screws. To accommodate its legs 132.1 and 132.2 corresponding or complementary slits 135 are milled into the upper ends of the rear leg rods. Thus, one can push the backrest 124 into position from above. Central bores 134 in the upper free end parts of the leg rods and an inserts 135 shaped to fit therein, and visible in FIG. 22, close off the upper ends and, importantly, hold the two leg rods reliably together, thereby mounting the backrest 124.

Figure 23:
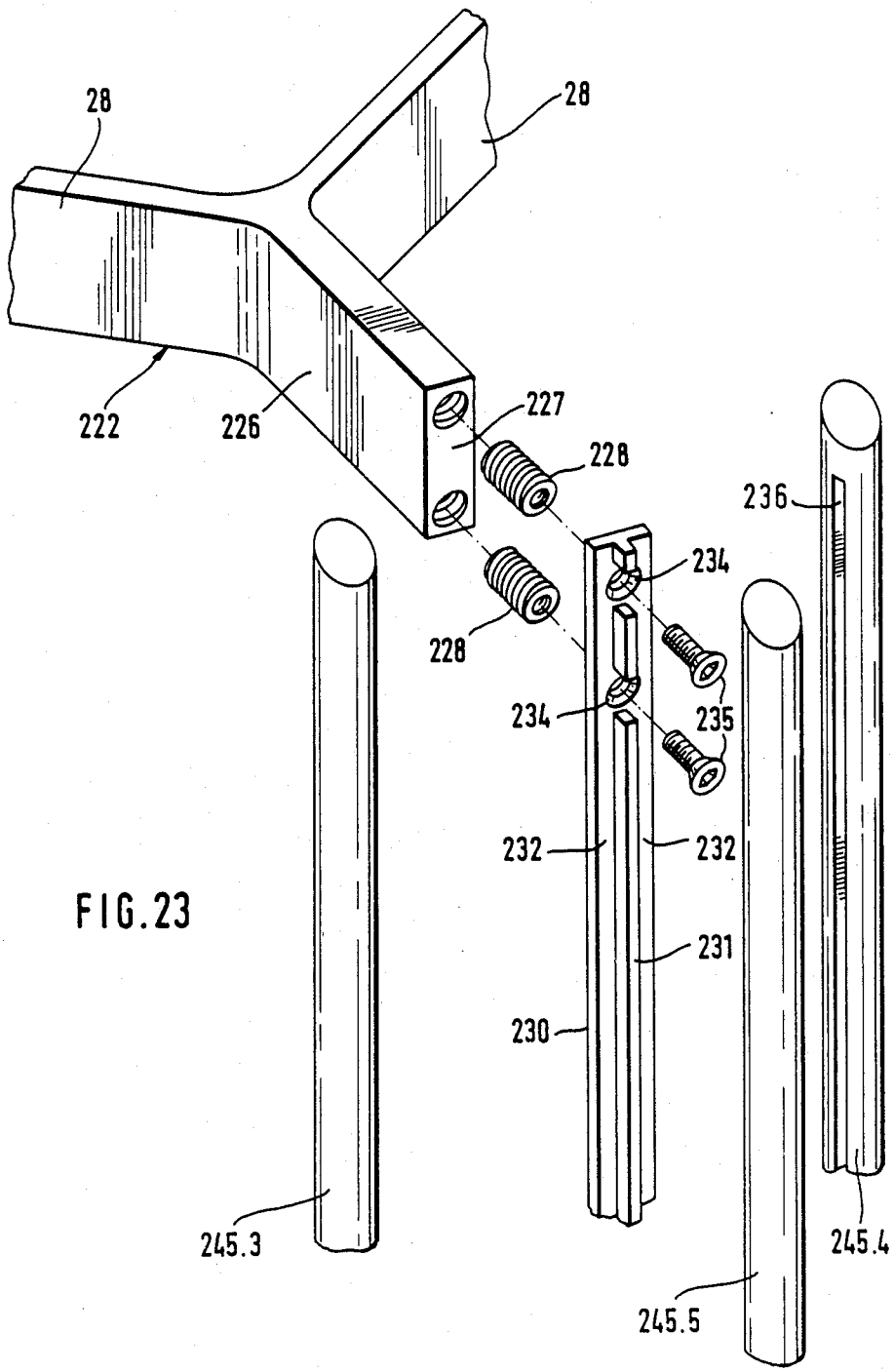
Figure 24:
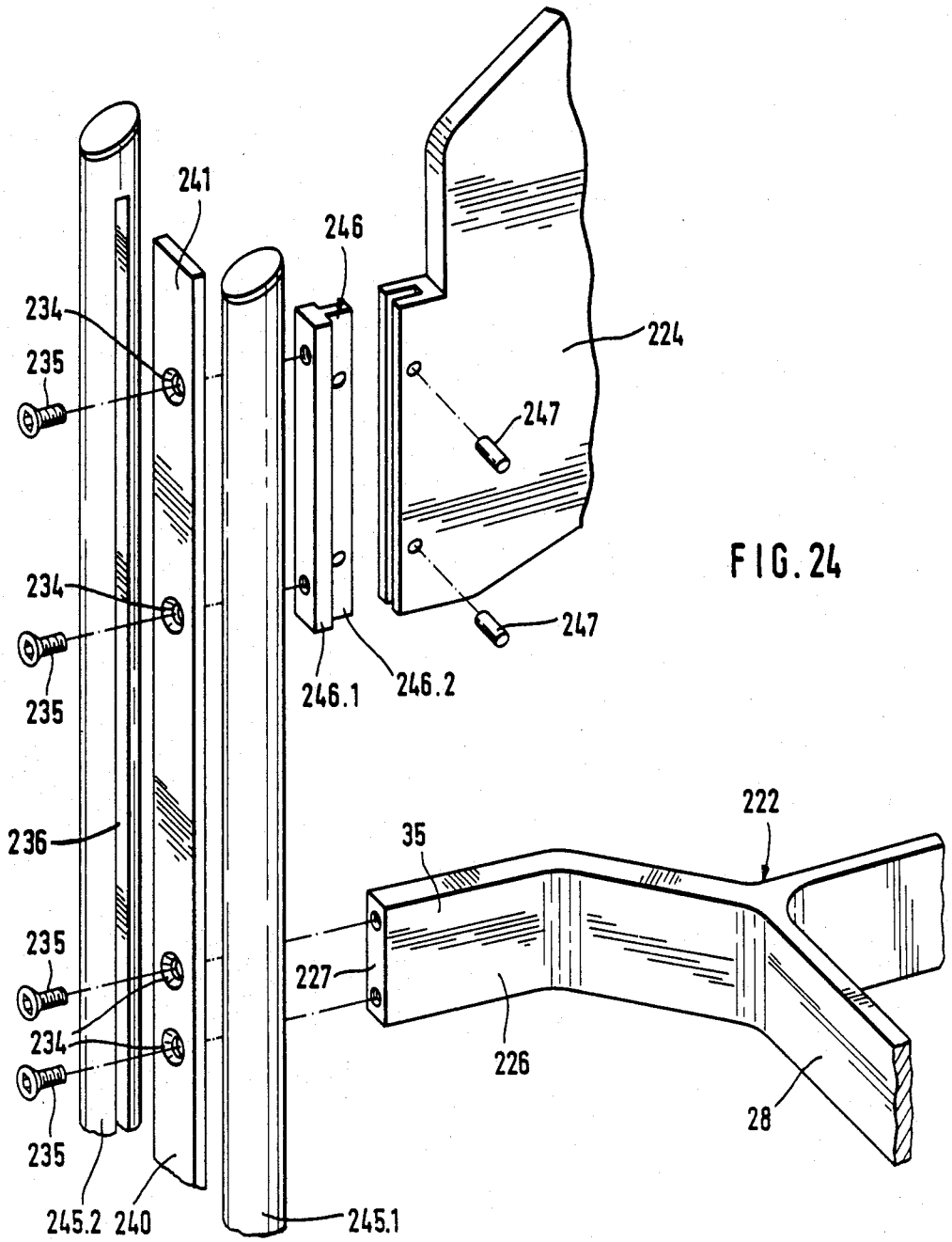

In a further embodiment shown in FIGS. 23 and 24 there is provided a hidden central underframe 222 whose arms 226 end straight. The latter can consist of metal or be assembled together from individual molded plywood members. Inserts to be described can be screwed onto the end faces 227 of the arms 226, which latter if made of wood or the like can be provided with interiorly and exteriorly threaded socket joints 228.

For each front leg a respective T-profile bar 230 is provided whose web 231 projects diagonally outward and at its upper end region is absent in places in order to leave space for two mounting bores 234 and screws 235. The thickness and length of the web 231 as well as of the legs 232 are so chosen that they can be readily pushed into corresponding longitudinal grooves 236 identically provided in each one of the three round leg rods without danger of fracturing the wood. The leg rods are here essentially cladding for the actual T-shaped load-carrying metal inserts 230. However, the leg rods project upwardly beyond the respective insert members and accordingly entirely cover the load-bearing structure.

For each rear leg a flat metallic insert bar 240 is provided which is so dimensioned regarding its thickness and breadth that the solid wood round leg rod 245.1 and 245.2 can be pushed onto it. At the appropriate locations through-bores 234 are provided for screws 235 and, as it happens, likewise are provided in the vicinity of the upper end 241. Here there is provided a suitably dimensioned backrest-mounting member metal insert 246 which is of T-shaped cross section and which, at its flat legs 246.1, is securely screwed to the flat bar insert 240, the T-shaped insert 246 having an inwardly projecting mounting web 246.2 onto which the slitted edge portion of the contoured wood backrest 224 can be pushed into place and, for example by means of the pins 247, mounted. Each of the two rods 245.1 and 245.2 of the shown rear leg is provided with a longitudinal slit 236, such slit being visible in FIG. 24 only on leg rod 245.2, the slit on the other leg rod 245.1 facing thereto. These slits permit the two leg rods to be pushed over and hide respective edge regions of the mounted metal insert 240, the mounting bores 234 of the latter and the mounting screws 235 that penetrate them all being countersunk to facilitate this. The facing longitudinal slits 236 on the two leg rods terminate prior to the tops of the leg rods, in order that the leg rods hide the true load-bearing structure as completely as possible.

In the embodiments depicted herein, the leg rods are consistently of circular cross section. It will be understood, however, that many of the herein disclosed principles of the invention would equally apply to leg rods of non-circular, e.g., quadrilateral, cross section, and indeed would no less apply to chair designs in which the front and rear legs are single elements and not made up of leg rods in the first place.

Also, in the foregoing illustrated embodiments, the underframe 22, 122 or 222 always comprises a rectangular main part 25 and diagonally outwardly projecting leg connecting arms, and is assembled, as already described, from four sub-units. It will be understood, however, that this but exemplary. In principle, the underframe could be a unitary cast body or, alternatively, be assembled from more than four sub-units. Also, the underframe has been illustrated as a generally planar member of uniform vertical dimension. In certain circumstances where this would conceivably interfere with the seat contour, or for other reasons, the underframe could be other than planar in its basic geometry. Likewise, although its main part 25 is here shown rectangular, the main part could be non-rectangular, for example oval. It will be clear that numerous other possibilities exist for the construction and appearance of the underframe, particular to the degree that the underframe is, in fact, a hidden underframe. For example, the underframe could be provided in the form of a one-piece, or assembled, spider-web-like structure in order to minimize the volume of material it consumes while not sacrificing its strength and rigidity.

Although the invention has been illustrated with regard to embodiments all of a very similar design appearance, it will be very clear that various principles of the invention are no less applicable to chairs of an appearance drastically different from the chairs depicted herein.

Indeed, the number of modifications and variants which can result by differing combinations of the structural principles disclosed herein is so great as to preclude any attempt at listing them here, but these will be clear to persons skilled in the art.

I claim:

1. A chair, comprising, in combination:

four legs (21, 121), including two front legs and two rear legs;

a seat (23), a backrest (24, 124, 224), a hidden central underframe (22, 122, 222) connecting the legs (21, 121), mounting and supporting the seat (23), and being located beneath the seat (23), the rear legs extending upward to a level above the seat and mounting the backrest (24, 124, 224) at the lateral edge regions of the backrest, each leg comprising at least two leg rods, the leg rods being straight rods of circular section, and the at least two constituent leg rods of each leg extending parallel to each other and directly adjoining each other along their lengths, the hidden central underframe (22, 122, 222) being provided with outwardly projecting leg-connecting arms (26, 126, 226) which extend in directions from the central area beneath the seat towards respective ones of the legs (21, 121), each two leg rods (45, 145, 245) of a leg (21, 121) together defining a pair of lengthwise recesses, each lengthwise recess being located to one side of the line along which the two leg rods directly adjoin each other, the leg rods of each leg being so positioned that each leg has one such lengthwise recess that is an inwardly facing lengthwise recess, the outer end of each leg-connecting arm (26, 126, 226) extending into the inwardly facing lengthwise recess of a respective one of the legs and being at such location joined to the respective leg in a manner forming a chair frame formed by the front and rear legs and by the hidden central underframe, wherein the chair is of stackable design, and wherein the constituent leg rods (45) of each leg are provided with longitudinally extending, circumferentially narrow, and radially short, outwardly projecting protective ribs (60), to protect the surface finish of the leg rods in the event of stacking and unstacking of such chairs.

2. A chair, comprising, in combination:

four legs (21, 121) including two front legs and two rear legs;

a seat (23), a backrest (24, 124, 224), a hidden central underframe (22, 122, 222) connecting the legs (21, 121), mounting and supporting the seat (23), and being located beneath the seat (23), the rear legs extending upward to a level above the seat and mounting the backrest (24, 124, 224) at the lateral edge regions of the backrest, each leg comprising at least two leg rods, the leg rods being straight rods of circular section, and the at least two constituent leg rods of each leg extending parallel to each other and directly adjoining each other along their lengths, the hidden central underframe (22, 122, 222) being provided with outwardly projecting leg-connecting arms (26, 126, 226) which extend in directions from the central area beneath the seat towards respective ones of the legs (21, 121), each two leg rods (45, 145, 245) of a leg (21, 121) together defining a pair of lengthwise recesses, each lengthwise recess being located to one side of the line along which the two leg rods directly adjoin each other, the leg rods of each leg being so positioned that each leg has one such lengthwise recess that is an inwardly facing lengthwise recess, the outer end of each leg-connecting arm (26, 126, 226) extending into the inwardly facing lengthwise recess of a respective one of the legs and being at such location joined to the respective leg in a manner forming a chair frame formed by the front and rear legs and by the hidden central underframe, wherein each leg rod (45) is tubular and is provided with an internal, radially inward projecting longitudinally extending rib (51) serving to reinforce the leg rod and to provide a means for preventing an inserted capping plug from rotating.

3. A chair, comprising, in combination:

four legs (21, 121), including two front legs and two rear legs;

a seat (23), a backrest (24, 124, 224), a hidden central underframe (22, 122, 222) connecting the legs (21, 121), mounting and supporting the seat (23) and being located beneath the seat (23), the rear legs extending upward to a level above the seat and mounting the backrest (24, 124, 224) at the lateral edge regions of the backrest, each leg comprising at least two leg rods, the leg rods being straight rods of circular section, and the at least two constituent leg rods of each leg extending parallel to each other and directly adjoining each other along their lengths, the hidden central underframe (22, 122, 222) being provided with outwardly projecting leg-connecting arms (26, 126, 226) which extend in directions from the central area beneath the seat towards respective ones of the legs (21, 121), each two leg rods (435, 145, 245) of a leg (21, 121) together defining a pair of lengthwise recesses, each lengthwise recess being located to one side of the line along which the two leg rods directly adjoin each other, the leg rods of each leg being so positioned that each leg has one such lengthwise recess that is an inwardly facing lengthwise recess, the outer end of each leg-connecting arm (26, 126, 226) extending into the inwardly facing lengthwise recess of a respective one of the legs and being at such location joined to the respective leg in a manner forming a chair frame formed by the front and rear legs and by the hidden central underframe, wherein the backrest (24, 124) is of peaked configuration at its top, with first and second top edge regions (86) located to either side of a central peak and downwardly slanting therefrom, and wherein the top ends of the rear legs ? ? (21.3, 21.4; 121.3, 121.4) have downwardly and outwardly slanted end faces whose slant coincides with the slant of the top edge regions (86) of the backrest.

4. A chair as defined in claim 3, wherein the leg-connecting arms (26, 126, 226) of the hidden central underframe (22, 122, 222) are joined to the front legs (21.1, 21.2; 121.1, 121.2; etc.) at locations thereon beneath the upper boundary (e.g. 62 in FIG. 4) of the front legs, and wherein the lateral edge regions of the backrest (24, 124, etc.) are joined to the rear legs (21.3, 21.4; 121.3, 121.4; etc.) at locations thereon beneath the upper boundary (e.g. 80 in FIG. 10) of the rear legs.

5. A chair, comprising, in combination:

four legs (21, 121), including two front legs and two rear legs;

a seat (23), a backrest (24, 124, 224), a hidden central underframe (22, 122, 222) connecting the legs (21, 121), mounting and supporting the seat (23), and being located beneath the seat (23), the rear legs extending upward to a level above the seat and mounting the backrest (24, 124, 224) at the lateral edge regions of the backrest, each leg comprising at least two leg rods, the leg rods being straight rods of circular section, and the at least two constituent leg rods of each leg extending parallel to each other and directly adjoining each other along their lengths, the hidden central underframe (22, 122, 222) being provided with outwardly projecting leg-connecting arms (26, 126, 226) which extend in directions from the central area beneath the seat towards respective ones of the legs (21, 121), each two leg rods (45, 14, 245) of a leg (21, 121) together defining a pair of lengthwise recesses, each lengthwise recess being located to one side of the line along which the two leg rods directly adjoin each other, the leg rods of each leg being so positioned that each leg has one such lengthwise recess that is an inwardly facing lengthwise recess, the outer end of each leg-connecting arm (26, 126, 226) extending into the inwardly facing lengthwise recess of a respective one of the legs and being at such location joined to the respective leg in a manner forming a chair frame formed by the front and rear legs and by the hidden central underframe, wherein the constituent leg rods (45, 145, 245) of each leg have planar slanted end faces, the slanted end faces of the leg rods of each individual leg all being located in a common respective plane of slant.

6. A chair, comprising, in combination:

four legs (21, 121), including two front legs and two rear legs;

a seat (23), a backrest (24, 124, 224), a hidden central underframe (22, 122, 222) connecting the legs (21, 121), mounting and supporting the seat (23), and being located beneath the seat (23), the rear legs extending upward to a level above the seat and mounting the backrest (24, 124, 224) at the lateral edge regions of the backrest, each leg comprising at least two leg rods, the leg rods being straight rods of each leg extending parallel to each other and directly adjoining each other along their lengths, the hidden central underframe (22, 122, 222) being provided with outwardly projecting leg-connecting arms (26, 126, 226) which extend in directions from the central area beneath the seat towards respective ones of the legs (21, 121), each two leg rods (45, 145, 245) of a leg (21, 121) together defining a pair of lengthwise recesses, each lengthwise recess being located to one side of the line along which the two leg rods directly adjoin each other, the leg rods of each leg being so positioned that each leg has one such lengthwise recess that is an inwardly facing lengthwise recess, the outer end of each leg-connecting arm (26, 126, 226) extending into the inwardly facing lengthwise recess of a respective one of the legs and being at such location joined to the respective leg in a manner forming a chair frame formed by the front and rear legs and by the hidden central underframe, wherein the leg rods of the legs (21) are formed of extruded aluminum tubes, the upper ends of the tubular leg rods of each chair leg being closed off by a capping plug provided with projections that extend into the interiors of the tubular leg rods, each capping plug being a single element configured to help hold together the constituent leg rods of a leg.

7. A chair, comprising, in combination:

four legs (21, 121), including two front legs and two rear legs;

a seat (23), a backrest (24, 124, 224), a hidden central underframe (22, 122, 222) connecting the legs (21, 121), mounting and supporting the seat (23), and being located beneath the seat (23), the rear legs extending upward to a level above the seat and mounting the backrest (24, 124, 224) at the lateral edge regions of the backrest, each leg comprising at least two leg rods, the leg rods being straight rods of circular section, and the at least two constituent legrods of each leg extending parallel to each other and directly adjoining each other along their lengths, the hidden central underframe (22, 122, 222) being provided with outwardly projecting leg-connecting arms (26, 126, 226) which extend in directions from the central area beneath the seat towards respective ones of the legs (21, 121), each two leg rods (45, 145, 245) of a leg (21, 121) together defining a pair of lengthwise recesses, each lengthwise recess being located to one side of the line along which the two leg rods directly adjoin each other, the leg rods of each leg being so positioned that each leg has one such lengthwise recess that is an inwardly facing lengthwise recess, the outer end of each leg-connecting arm (26, 126, 226) extending into the inwardly facing lengthwise recess of a respective one of the legs and being at such location joined to the respective leg in a manner forming a chair frame formed by the front and rear legs and by the hidden central underframe, wherein the hidden central underframe (22, 122, 222) of the chair comprises a rectangular main part (25) formed by four walls and having four corner portions, the outwardly projecting leg-connecting arms (26, etc.) each projecting diagonally outward from one of the four corner portions.

8. A chair as defined in claim 7, wherein the two leg-connected arms (26.1, 26.2; 126; 226) that are joined to respective ones of the front legs (21.1, 21.2; 121.1, 121.2; etc.) each extend diagonally for their entire lengths of these two leg-connecting arms.

9. A chair as defined in claim 7, wherein the two leg-connecting arms (26.3, 26.4; etc.) that are joined to respective ones of the rear legs (21.3, 21.4; 121.3, 121.4; etc.) initially project diagonally outward from the rectangular main part (25) of the central underframe (22, 122) until they reach a plane (40) containing the two rear legs, and from such plane (40) then extend parallel to such plane to the location on the respective rear leg at which they are joined to the respective rear leg.

10. A chair, comprising, in combination:

four legs (21, 121), including two front legs and two rear legs;

a seat (23), a backrest (24, 124, 224), a hidden central underframe (22, 122, 222) connecting the legs (21, 121), mounting and supporting the seat (23), and being located beneath the seat (23), the rear legs extending upward to a level above the seat and mounting the backrest (24, 124, 224) at the lateral edge regions of the backrest, each leg comprising at least two leg rods, the leg rods being straight rods of circular section, and the at least two constituent leg rods of each leg extending parallel to each other and directly adjoining each other along their lengths, the hidden central underframe (22, 122, 222), being provided with outwardly projecting leg-connecting arms (26, 126, 226) which extend in directions from the central area beneath the seat towards respective ones of the legs (21, 121), each two leg rods (45, 145, 245) of a leg (21, 121) together defining a pair of lengthwise recesses, each lengthwise recess being located to one side of the line along which the two leg rods directly adjoin each other, the leg rods of each leg being so positioned that each leg has one such lengthwise recess that is an inwardly facing lengthwise recess, the outer end of each leg-connecting arm (26, 126, 226) extending into the inwardly facing lengthwise recess of a respective one of the legs and being at such location joined to the respective leg in a manner forming a chair frame formed by the front and rear legs and by the hidden central underframe, wherein the outer end (36) of each leg-connecting arm (26) is tapered and, outwardly of the taper, is chamfered, to facilitate said extending of the outer end (36 into the inwardly facing lengthwise recess of the respective one of the legs.

11. A chair as defined in claim 7, wherein the rectangular main part of he central underframe (22) is provided at each of its four corner regions with a vertically extending longitudinal mounting bore for receiving mounting elements to mount the seat (24) on the underframe (22).

12. A chair as defined in claim 7, wherein the central underframe (22) is constituted by four sub-units (22.1, 22.2, 22.3, 22.4, FIG. 9), each sub-unit being a severed longitudinal increment of extruded profiled metallic stock, wherein each such sub-unit includes a respective one of the diagonally outward projecting leg-connecting arms (26.1, 26.2, etc.) and, to either side of the respective leg-connecting arm and of one piece therewith, two mutually perpendicular wall-forming legs (28) each of which forms approximately half of one of the four walls of the rectangular main part(25) of the underframe (22), and wherein at least two of the four sub-units are entirely identical to each other, but in assembled condition of the underframe (22) are arranged mirror-symmetrical to each other.

13. A chair as defined in claim 12, wherein each of the wall-forming legs (28) of each sub-unit (22.1, 22.2, 22.3, 22.4, FIG. 9) of the underframe (22) has a thickened end portion (29) provided with a slit (30), wherein, in assembled condition of the underframe (22), the slit (30) at the end portion (29) of one sub-unit registers with the slit (30) at the adjoining end portion (29) of an adjoining sub-unit and the two registering slits (30) together receive a single connecting plate (30) having an outer face which forms a smooth continuation of the outer faces of the adjoining end portions (29), and wherein the end portion (29) of each sub-unit (22.1, 22.2, etc.) has a chamfer (31) at its inner face, the chamfers (31) of the two adjoining end portions (29) of each two adjoining sub-units together forming a V-shaped recess (31, 31) that extends perpendicular to the general plane of the underframe (22) and receives a weld seam (32).

14. A chair, comprising, in combination:

four legs (21, 121), including two front legs and two rear legs;

a seat (23), a backrest (24, 124, 224), a hidden central underframe (22, 122, 222) connecting the legs (21, 121), mounting and supporting the seat (23), and being located beneath the seat (23), the rear legs extending upward to a level above the seat and mounting the backrest (24, 124, 224) at the lateral edge regions of the backrest, each leg comprising at least two leg rods, the leg rods being straight rods of circular section, and the at least two constituent leg rods of each leg extending parallel to each other and directly adjoining each other along their lengths, the hidden central underframe (22, 122, 222) being provided with outwardly projecting leg-connecting arms (26, 126, 226) which extend in directions from the central area beneath the seat towards respective ones of the legs (21, 121), each two leg rods (45, 145, 245) of a leg (21, 121) together defining a pair of lengthwise recesses, each lengthwise recess being located to one side of the line along which the two leg rods directly adjoin each other, the leg rods of each leg being so positioned that each leg has one such lengthwise recess that is an inwardly facing lengthwise recess, the outer end of each leg-connecting arm (26, 126, 226) extending into the inwardly facing lengthwise recess of a respective one of the legs and being at such location joined to the respective leg in a manner forming a chair frame formed by the front and rear legs and by the hidden central underframe, wherein the constituent leg rods of each leg of the chair are formed by connected together increments of solid wood circular rod stock, wherein the ends of the leg-connecting arms (126) of the chair's hidden central underframe (122) are of outwardly flaring dovetail shape (FIG. 21), and wherein each of two leg rods of each leg is provided with part of a recess complementary to the dovetail-shaped ends of the respective leg-connecting arm (126), such that these two leg rods jointly form a recess complementary to the dovetail-shaped ends.

15. A chair as defined in claim 7, wherein the hidden central underframe, (122, 222) of the chair including the leg-connecting arms (126, 226) thereof is formed from cast resin-bound wood particles, with long fibers of reinforcing material such as high-tensile-strength plastic embedded therein, such fibers extending interiorly long the walls of the rectangular main part (125) of the central underframe (122, 222) to, into and along the interior of the upwardly projecting leg-connecting arms (26) of the central underframe (122, 222).

16. A chair, comprising, in combination:

four legs (21, 121), including two front legs and two rear legs;

a seat (23), a backrest (24, 124, 224), a hidden central underframe (22, 122, 222) connecting the legs (21, 121) mounting and supporting the seat (23), and being located beneath the seat (23), the rear legs extending upward to a level above the seat and mounting the backrest (24, 124, 224) at the lateral edge regions of the backrest, each leg comprising at least two leg rods, the leg rods being straight rods of circular section, and the at least two constituent leg rods of each leg extending parallel to each other and directly adjoining each other along their lengths, the hidden central underframe (22, 122, 222) being provided with outwardly projecting leg-connecting arms (26, 126, 226) which extend in directions form the central area beneath the seat towards respective ones of the legs (21, 121), each two leg rods (45, 145, 245) of a leg (21, 121) together defining a pair of lengthwise recesses, each lengthwise recess being located to one side of the line along which the two leg rods directly adjoin each other, the leg rods of each leg being so positioned that each leg has one such lengthwise recess that is an inwardly facing lengthwise recess, the outer end of each leg-connecting arm (26, 126, 226) extending into the inwardly facing lengthwise recess of a respective one of the legs and being at such location joined to the respective leg in a manner forming a chair frame formed by the front and rear legs and by the hidden central underframe, wherein the backrest (124, FIG. 22) has at each of its lateral edge regions a vertical edge face (125) to which is attached a vertically extending profiled metallic member (125) of generally dovetail-like cross section, and wherein each rear leg (121.3, 121.4) includes two solid wood leg rods (145.2) of circular section which directly adjoin each other along their lengths, each being provided with a milled slot (133) so configured that the slots (133f) of the two directly adjoining leg rods together form a longitudinally extending recess which receives the profiled metallic member (125) of generally dovetail-like cross section.

17. A chair, comprising, in combination:

four legs (21, 121) including two front legs and two rear legs;

a seat (23), a backrest (24, 124, 224), a hidden central underframe (22, 122, 222) connecting the legs (21, 121), mounting and supporting the seat (23), and being located beneath the seat (23), the rear legs extending upward to a level above the seat and mounting the backrest (24, 124, 224) at the lateral edge regions of the backrest, each leg comprising at least two leg rods, the leg rods being straight rods of circular section, and the at least two constituent leg rods of each leg extending parallel to each other and directly adjoining each other along their lengths, the hidden central underframe (22, 122, 222) being provided with outwardly projecting leg-connecting arms (26, 126, 226) which extend in directions from the central area beneath the seat towards respective ones of the legs (21, 121), each two leg rods (45, 145, 245) of a leg (21, 121) together defining a pair of lengthwise recesses, each lengthwise recess being located to one side of the line along which the two leg rods directly adjoin each other, the leg rods of each leg being so positioned that each leg has one such lengthwise recess that is inwardly facing lengthwise recess, the outer end of each leg-connecting arm (26, 126, 226) extending into the inwardly facing lengthwise recess of a respective one of the legs and being at such location joined to the respective leg in a manner forming a chair frame formed by the front and rear legs and by the hidden central underframe, wherein the front leg-connecting arms (126) of the chair's central underframe (122) each have ends (127) of outwardly flaring dovetail shape (FIGS. 19–21), wherein each front leg (121.1, 121.2) includes two solid wood leg rods (145.3, 145.4) of circular section which directly adjoin each other along their lengths, each being provided with a milled slot so configured that the slots of the two directly adjoining leg rods (144.3, 145.4) together form a longitudinally extending recess which is complementary to and receives the outwardly flaring dovetail-shaped end (127) of the respective one of the front leg-connecting arms (126), wherein each front leg (121.1, 121 2) furthermore includes a third solid wood leg rod (145.5) of circular section which directly adjoins each of the aforementioned two leg rods of the respective leg along their lengths, each front leg furthermore being provided with at least one dowel (129) having a first end which extends into the end of the respective front leg-connecting arm (126) in the direction of elongation of the latter and a second end which extends into a dowel-receiving recess formed in the third leg rod (145.5), to connect the third leg rod to the end of the respective leg-connecting arm (126), the dowel-receiving recess terminating interiorly of the third leg rod, in order that the third leg rod also serve to hide the existence of the dowel (129).

18. A chair, comprising, in combination:

four legs (21, 121), including two front legs and two rear legs;

a seat (23), a backrest (24, 124, 224), a hidden central underframe (22, 122, 222) connecting the legs (21, 121), mounting and supporting the seat (23), and being located beneath the seat (23), the rear legs extending upward to a level above the seat and mounting the backrest (24, 124, 224) at the lateral edge regions of the backrest, each leg comprising at least two leg rods, the leg rods being straight rods of circular section, and the at least two constituent leg rods of each leg extending parallel to each other and directly adjoining each other along their lengths, the hidden central underframe (22,122,222) being provided with outwardly projecting leg-connecting arms (26, 126, 226) which extend in directions from the central area beneath the seat towards respective ones of the legs (21, 121), each two leg rods (45, 145, 245) of a leg (21, 121) together defining a pair of lengthwise recesses, each lengthwise recess being located to one side of the line along which the two leg rods directly adjoin each other, the leg rods of each leg being so positioned that each leg has one such lengthwise recess that is an inwardly facing lengthwise recess, the outer end of each leg-connecting arm (26, 126, 226) extending into the inwardly facing lengthwise recess of a respective one of the legs and being at such location joined to the respective leg in a manner forming a chair frame formed by the front and rear legs and by the hidden central underframe, wherein (FIG. 24) the end of each rear leg-connecting arm (226) of the central underframe (222) has an end face (227) to which an elongated, vertically extending flat bar (240) is by means of screws attached in face-to-face contact with the end face (227), wherein (FIG. 24) each rear leg comprises two solid wood leg rods (245.1, 245.2) of circular section, the two leg rods being of a diameter substantially greater than the thickness of the flat bar (24) and being of a length substantially greater than the length of the flat bar (240), the two leg rods (245.1, 245.2) being provided with respective, facing longitudinal slots (236), which receive respective lateral edge portions of the vertically extending flat bar (240), so that the two leg rods to a great degree hide the existence of the flat bar (240), wherein (FIG. 23) the end of each front leg-connecting arm (226) of the central underframe (222) has an end face (227) to which an elongated, vertically extending profiled bar (230) is attached, the prifled bar (230) being of T-shaped cross section and comprising a flat main web (232) and a projecting median web (231), the flat main web (232) being by means of screws attached to the end face (227) of the respective leg-connecting arm (226) in face-to-face contact therewith, the median web (231) projecting from the main web (232) in the same direction in which the end of the repective front leg-connecting arm (226) extends, and wherein (FIG. 23) each front leg comprises three solid wood leg rods (245.3, 245.4, 245.5) of circular section, the three leg rods being of a diameter substantially greater than the thickness of the main and median webs (232, 231) of the profiled bar (230) and being of a length substantially greater than the length of the profiled bar (230), the three leg rods (245.3, 245.4, 245.5) being provided with respective longitudinal slots (236), the longitudinal slot of one leg rod (245.5) receiving and hiding the median web (231) of the profiled bar (230), and the longitudinal slots of the other two leg rods (245.3, 245.4) each receiving and hiding one of the two lateral regions of the main web (232) of the profiled bar (230).

19. A chair as defined in claim 18, wherein the leg rods of the front legs extend, unslotted, upwardly beyond the top ends of the profiled bars (230), and wherein the leg rods of the rear legs extend upwardly beyond the top ends of the flat bars (240).

20. A chair as defined in claim 19, wherein the leg rods have markedly slanting top end faces.

21. A chair, comprising, in combination:

four legs (21, 121), including two front legs and two rear legs;

a seat (23), a backrest (24, 124, 224), a hidden central underframe (22, 122, 222) connecting the legs (21, 121), mounting and supporting the seat (23), and being located beneath the seat (23), the rear legs extending upward to a level above the seat and mounting the backrest (24, 124, 224) at the lateral edge regions of the backrest, each leg comprising at least two leg rods, the leg rods being straight rods of circular section, and the at least two constitutent leg rods of each leg extending parallel to each other and directly adjoining each other along their lengths, the hidden central underframe (22, 122, 222) being provided with outwardly projecting leg-connecting arms (26, 126, 226) which extend in directions from the central area beneath the seat towards respective ones of the legs (21, 121), each two legs rods (45, 145, 245) of a leg (21, 121) together defining a pair of lengthwise recesses, each lengthwise recess being located to one side of the line along which the two leg rods directly adjoin each other, the leg rods of each leg being so positioned that each leg has one such lengthwise recess that is an inwardly facing lengthwise recess, the outer end of each leg-connecting arm (26, 126, 226) extending into the inwardly facing lengthwise recess of a respective one of the legs and being at such location joined to the respective leg in a manner forming a chair frame formed by the front and rear legs and by the hidden central underframe, wherein (FIG. 12) mounting spacers (93.1, 93.2) are secured to the bottom of the seat (23), the mounting spacers (93) accommodating at their lower ends internally threaded socket joints (94), the mounting spacers (93) being secured to the chair's central underframe (22, 122, 222) by means of threaded connectors (99) which extend through the underframe (22, 122, 222) from below the same and mount the mounting spacers (93) above the underframe (22, 122, 222), furthermore including spring elements (102) provided for each of the mounting spacers (93) each location between the top of the underframe (22, 122, 222) and the bottom of the respective mounting spacer (93).

22. A chair as defined in claim 21, wherein the threaded connectors (99) pass through the spring elements (102), and wherein the threaded connectors can be tightened to a varying degree to thereby vary the pre-stress of the spring elements (102) and in that way vary the springiness of the attachment of the seat (23) to the underframe (22, 122, 222) and also vary the forward or backward tilt of the seat (23).

23. A chair as defined in claim 22, wherein the underframe (22, 122, 222) is provided with vertically oriented mounting bores (27), the threaded connectors (99) extending through the mounting bores (27) and having heads, and furthermore including means provided for causing the heads to be positioned intermediate the axial ends of the respective mounting bores (27) axially non-displaceable relative to the mounting bores (27).

24. A chair as defined in claim 23, wherein each mounting bore (27) is in part formed by an inwardly facing wall portion (96) of the underframe (22, 122, 222), wherein each inwardly facing wall portion (96) is provided with small through-going bores through which the legs of a positioning bracket (98) extend generally horizontally into the interior of the respective mounting bore (27), the respective threaded connector (99) passing between the legs of the bracket (98) but the head of the threaded connector (99) being prevented by the legs of the bracket (98) from advancing axially when the threaded connector is tightened to more than a certain degree, the respective spring element (102) having a lower end which is accommodated within the upper region of the respective mounting bore 27 and prevented by the legs of the bracket (98) from descending within the mounting bore (27) to a level beneath the legs of the bracket (98).

25. A chair, comprising, in combination:

four legs (21, 121), including two front legs and two rear legs;

a seat (23), a backrest (24, 124, 224), a hidden central underframe (22, 122, 222) connecting the legs (21, 121), mounting and supporting the seat (23), and being located beneath the seat (23), the rear legs extending upward to a level above the seat and mounting the backrest (24, 124, 224) at the lateral edge regions of the backrest, each leg comprising at least two leg rods, the leg rods being straight rods of circular section, and the at least two constitutent leg rods of each leg extending parallel to each other and directly adjoining each other along their lengths, the hidden central underframe (22, 122, 222) being provided with outwardly projecting leg-connecting arms (26, 126, 226) which extend in directions from the central area beneath the seat towards respective ones of the legs (21, 121), each twol leg rods (45, 145, 245) of a leg (21, 121) together defining a pair of lengthwise recess, each lengthwise recess being located to one side of the line along which the two leg rods directly adjoin each other, the leg rods of each leg being so positioned that each leg has one such lengthwise recess that is an inwardly facing lengthwise recess, the outer end of each leg-connecting arm (26, 126, 226) extending into the inwardly facing lengthwise recess of a respective leg in a manner forming a chair frame formed by the front and rear legs and by the hidden central underframe, wherein the seat (23) is a non-upholstered seat made of a rigid washable material and is provided in its central region with a set of through-going apertures serving for drainage of wash water when the seat has been washed, and serving to permit the clothing of a sitter to breathe.

26. A chair, comprising, in combination:

four legs (21, 121), including two front legs and two rear legs;

a seat (23), a backrest (24, 124, 224), a hidden central underframe (22, 122, 222) connecting the legs (21, 121), mounting and supporting the seat (23), and being located beneath the seat (23), the rear legs extending upward to a level above the seat and mounting the backrest (24, 124, 224) at the lateral edge regions of the backrest, each leg comprising at least two leg rods, the leg rods being straight rods of circular section, and the at least two constituent leg rods of each leg extending parallel to each other and directly adjoining each other along their lengths, the hidden central underframe (22, 122, 222) being provided with outwardly projecting leg-connecting arms (26, 126, 226) which extend in directions from the central are beneath the seat towards respective ones of the legs (21, 121), each two leg rods (45, 145, 245) of a leg (21, 121) together defining a pair of lengthwise recesses, each lengthwise recess being located to one side of the line along which the two leg rods directly adjoin each other, the leg rods of each leg being so positioned that each leg has one such lengthwise recess that is an inwardly facing lengthwise recess, the outer end of each leg-connecting arm (26, 126, 226) extending into the inwardly facing lengthwise recess of a respective one of the legs and being at such location joined to the respective leg in a manner forming a chair frame formed by the front and rear legs and by the hidden central underframe, wherein each rear leg (2I.3, 21.4) comprises two leg rods together defining said pair of lengthwise recesses, of which one is saids inwardly facing lengthwise recess and the other is an outwardly facing lengthwise recess, the chair being provided with left and right armrests, each comprising a bend-exhibiting armrest rod (110) of round cross section, each armrest rod (110) including:

a generally vertical rear interval (110.1) which extends along and is received within the outwardly facing lengthwise recess of the two legs of the respective rear leg (21.3, 21.4) and is secured to the rear leg in the region of the outwardly facing lengthwise recess thereof, followed by a generally horizontal, forwardly extending armrest-forming interval (110.2), followed by a generally vertical, downwardly extending front interval (110.3), followed by a generally horizontal, inwardly extending interval (110.4) which extends to a hidden location beneath the seat (23).

27. A chair, comprising, in combination:

four legs (21, 121), including two front legs and two rear legs;

a seat (23), a backrest (24, 124, 224), a hidden central underframe (22, 122, 222) connecting the legs (21, 121), mounting an supporting the seat (23), and being located beneath the seat (23), the rear legs extending upward to a level above the seat and mounting the backrest (24, 124, 224) at the lateral edge regions of the backrest, each leg comprising at least one leg rod, the leg rods being straight rods of circular section, the hidden central underframe (22, 122, 222) being provided with outwardly projecting leg-connecting arms (26, 126, 226) which extend in directions from the central area beneath the seat towards respective ones of the legs (21, 121), the outer end of each leg-connecting arm (26, 126, 226) extending to a respective one of the legs and being at such location joined to the respective leg in a manner forming a chair frame formed by the front and rear legs and by the hidden central underframe, wherein the chair is of stackable design, and wherein the leg rods (45) are provided with longitudinally extending, circumferentially narrow, and radially short, outwardly projecting protective ribs (60), to protect the surface finish of the leg rods in the event of stacking and unstacking of such chairs.

28. A chair, comprising, in combination:

four legs (21, 121), including two front legs and two rear legs;

a seat (23), a backrest (24, 124, 224), a hidden central underframe (22, 122, 222) connecting the legs (21, 121), mounting and supporting the seat (23), and being located beneath the seat (23), the rear legs extending upward to a level above the seat and mounting the backrest (24, 124, 224) at the lateral edge regions of the backrest, each leg comprising at least one leg rod, the leg rods being straight rods of circular section, the hidden central underframe (22, 122, 222) being provided with outwardly projecting leg-connecting arms (26, 126, 226) which extend in directions from the central area beneath the seat towards respective ones of the legs (21, 121), the outer end of each leg-connecting arm (26, 126, 226) extending to a respective one of the legs and being at such location joined to the respective leg in a manner forming a chair frame formed by the front and rear legs and by the hidden central underframe, wherein each leg rod (45) is tubular and is provided with an internal, radially inward projecting longitudinally extending rib (51) serving to reinforce the leg rod and to provide a means for preventinq an inserted capping plug from rotating.

29. A chair as defined in claim 43, wherein the leg-connecting arms (26, 126, 226) of the hidden central underframe (22, 122, 222) are joined to the front legs (21.1, 21.2; 121.1 121.2; etc.) at locations thereon beneath the upper boundary (e.g. 62 in FIG. 4) of the front legs, and wherein the lateral edge regions of the backrest (24, 124, etc) are joined to the rear legs (21.3, 21.4; 121.3 121.4; etc.) at locations thereon beneath the upper boundary (e.g. 80 in FIG. 10) of the rear legs.

30. A chair, comprising, in combination:

four legs (21, 121), including two front legs and two rear legs;

a seat (23), a backrest (24, 124, 224), a hidden central underframe (22, 122, 222) connecting the legs (21, 121), mounting and supporting the seat (23), and being located beneath the seat (23), the rear legs extending upward to a level above the seat and mounting the backrest (24, 124, 224) at the lateral edge regions of the backrest, each leg comprising at least one leg rod, the leg rods being straight rods of circular section, the hidden central underframe (22, 122, 222) being provided with outwardly projecting leg-connecting arms (26, 126, 226) which extend in directions from the central area beneath the seat towards respective ones of the legs (21, 121), the outer end of each leg-connecting arm (26, 126, 226) extending to a respective one of the legs and being at such location joined to the respective leg in a manner forming a chair frame formed by the front and rear legs and by the hidden central underframe, wherein the hidden central underframe (22, 122, 222) of the chair comprises a rectangular main part (25) formed by four walls and having four corner portions, the outwardly projecting leg-connecting arms (26, etc.) each projecting diagonally outward from one of the four corner portions.

31. A chair as defined in claim 30, wherein the two leg-connecting arms (26.1, 26.2; 126; 226) that are joined to respective ones of the front legs (21.1, 21.2; 121.1, 121.2; etc.) each extend diagonally for their entire lengths of these two leg-connecting means.

32. A chair as defined in claim 30, wherein the two leg-connecting arms (26.3, 26.4; etc.) that are joined to respective ones of the rear legs (21.3, 21.4; 121.3, 121.4; etc.) initially project diagonally outward from the rectangular main part (25) of the central underframe (22, 122) until they reach a plane (40) containing the two rear legs, and from such plane (40) then extend parallel to such plane to the location on the respective rear leg at which they are joined to the respective rear leg.

33. A chair as defined in claim 30, wherein the rectangular main part of the central underframe (22) is provided at each of its four corner regions with a vertically extending longitudinal mounting bore for receiving mounting elements to mount the seat (24) on the underframe (22).

34. A chair as defined in claim 30, wherein the central underframe (22) is constituted by four sub-units (22.1 22.2, 22.3, 22.4, FIG. 9) each sub-unit being a severed longitudinal increment of extruded profiled metallic stock, wherein each such sub-unit includes a respective one of the diagonally outward projecting leg-connecting arms (26.1, 26.2, etc.) and, to either side of the respective leg-connecting arm and of one piece therewith, two mutually perpendicular wall-forming legs (28) each of which forms approximately half of one of the four walls of the rectangular main part (25) of the underframe (22), and wherein at least two of the four sub-units are entirely identical to each other, but in assembled condition of the underframe (22) are arranged mirror-symmetrical to each other.

35. A chair as defined in claim 34, wherein each of the wall-forming legs (28) of each subunit (22.1, 22.2, 22.3, 22.4, FIG. 9) of the underframe (22) has a thickened end portion (29) provided with a slit (30), wherein, in assembled condition of the underframe (22, the slit (30) at the end portion (29) of one sub-unit registers with the slit (30) at the adjoining end portion (29) of an adjoining sub-unit and the two registering slits (30) together receive a single connecting plate (30) having an outer face which forms a smooth continuation of the outer faces of the adjoining end portions (29), and wherein the end portion (29) of each sub-unit (22.1, 22.2, etc.) has a chamfer (31) at its inner face, the chamfers (31) of the two adjoining end portions (29) of each two adjoining sub-units together forming a V-shaped recess (31, 31) that extends perpendicular to the general plane of the underframe (22) and receives a weld seam (32).

36. A chair, comprising, in combination:

four legs (21, 121), including two front legs and two rear legs;

a seat (23),
a backrest (24, 124, 224),
a hidden central underframe (22, 122, 222) connecting the legs (21, 121), mounting and supporting the seat (23), and being located beneath the seat (23),
the rear legs extending upward to a level above the seat and mounting the backrest (24, 124, 224) at the lateral edge regions of the backrest,
each leg comprising at least one leg rod, the leg rods being straight rods of circular section,
the hidden central underframe (22, 122, 222) being provided with outwardly projecting leg-connecting arms (26, 126, 226) which extend in directions from the central area beneath the seat towards respective ones of the legs (21, 121),
the outer end of each leg-connecting arm (26, 126, 226) extending to a respective one of the legs and being at such location joined to the respective leg in a manner forming a chair frame formed by the front and rear legs and by the hidden central underframe,
wherein the backrest (24, 124) is of peaked configuration at its top, with first and second top edge regions (86) located to either side of a central peak and downwardly slanting therefrom,
and wherein the top ends of the rear legs (21.3, 21.4; 121.3, 121.4) have downwardly and outwardly slanted end faces whose slant coincides with the slant of the top edge regions (86) of the backrest.

37. A chair as defined in claim 30,
wherein the hidden central underframe (122, 222) of the chair including the leg-connecting arms (126, 226) thereof is formed from casst resin-bound wood particles, with long fibers of reinforcing material such as high-tensile-strength plastic embedded therein, such fibers extending interiorly along the walls of the rectangular main part (125) of the central underframe (122, 222) to, into and along the interior of the outwardly projecting leg-connecting arms (126) of the central underframe (122, 222).

38. A chair, comprising, in combination:
four legs (21, 121), including two front legs and two rear legs;
a seat (23),
a backrest (24, 124, 224),
a hidden central underframe (22, 122, 222) connecting the legs (21, 121), mounting and supporting the seat (23), and being located beneath the seat (23),
the rear legs extending upward to a level above the seat and mounting the backrest (24, 124, 224) at the lateral edge regions of the backrest,
each leg comprising at least one leg rod, the leg rods being straight rods of circular section,
the hidden central underframe (22, 122, 222) being provided with outwardly projecting leg-connecting arms (26, 126, 226) which extend in directions from the central area beneath the seat towards respective ones of the legs (21, 121),
the outer end of each leg-connecting arm (26, 126, 226) extending to a respective one of the legs and being at such location joined to the respective leg in a manner forming a chair frame formed by the front and rear legs and by the hidden central underframe,
wherein the backrest (i24, FIG. 22) has at each of its lateral edge regions a vertical edge face (125) to which is attached a vertically extending profiled metallic member (125) of generally dovetail-like cross section, and
wherein each rear leg (121 3, 121.4) includes two solid wood leg rods (145.1, 145.2) of circular section which directly adjoin each other along their lengths, each being provided with a milled slot (133) so configured that the slots (133) of the two directly adjoining leg rods together form a longitudinally extending recess which receives the profiled metallic member (125) of generally dovetail-like cross section.

39. A chair, comprising, in combination:
four legs (21, 121), including two front legs and two rear legs;
a seat (23),
a backrest (24, 124, 224),
a hidden central underframe (22, 122, 222) connecting the legs (21, 121), mounting and supporting the seat (23), and being located beneath the seat (23),
the rear legs extending upward to a level above the seat and mounting the backrest (24, 124, 224) at the lateral edge regions of the backrest,
each leg comprising at least one leg rod, the leg rods being straight rods of circular section,
the hidden central underframe (22, 122, 222) being provided with outwardly projecting leg-connecting arms (26, 126, 226) which extend in directions from the central area beneath the seat towards respective ones of the legs (21, 121),
the outer end of each leg-connecting arm (26, 126, 226) extending to a respective ones of tho legs and being at such location joined to the respective leg in a manner forming a chair frame formed by the front and rear legs and by the hidden central underframe,
wherein (FIG. 12) mounting spacers (93.1, 93.2) are secured to the bottom of the seat (23), the mounting spacers (93) accommodating at their lower ends internally thread socket joints (94), the mounting spacers (93) being secured to the chair's central underframe (22, 122, 222) by means of the threaded connectors (99) which extend through the underframe (22, 122, 222) from below the same and mount the mounting spacers (93) above the underframe (22, 122, 222),
furthermore including spring elements (102) provided for each of the mounting spacers (93) each located between the top of the underframe (22, 122, 222) and the bottom of the respective mounting spacer (93).

40. A chair as defined in claim 39,
wherein the threaded connectors (99) pass through the spring elements (102, and wherein the threaded connectors can be tightened to a varying degree to thereby vary the pre-stress of the spring elements (102) and in that way vary the springiness of the attachment of the seat (23) to the underframe (22, 122, 222) and also vary the forward or backward tilt of the seat (23).

41. A chair as defined in claim 40,
wherein the underframe (22, 122, 222) is provided with vertically oriented mounting bores (27), the threaded connectors (99) extending through the mounting bores (27) and having heads, and furthermore including means provided for causing the heads to be positioned intermediate the axial ends of the respective mounting bores (27) axially non-displaceable relative to the mounting bores (27).

42. A chair as defined in claim 41, wherein each mounting bore (27) is in part formed by an inwardly facing wall portion (96) of the underframe (22, 122, 222), wherein each inwardly facing wall portion (96) is provided with small through-going bores through which the legs of a positioning bracket (98) extend generally horizontally into the interior of the respective mounting bore (27), the respective threaded connector (99) passing between the legs of the bracket (98) but the head of the threaded connector (99) being prevented by the legs of the bracket (98) from advancing axially when the threaded connector is tightened to more than a certain degree, the respective spring element (102) having a lower end which is accommodated within the upper region of the respective mounting bore 27 and prevented by the legs of the bracket (98) from descending within the mounting bore (27) to a level beneath the legs of the bracket (98).

* * * * *